US006209277B1

(12) United States Patent
DiGate

(10) Patent No.: US 6,209,277 B1
(45) **Date of Patent: *Apr. 3, 2001**

(54) WALLBOARD REPAIR CLIP, METHOD OF REPAIRING WALLBOARD, AND KIT FOR REPAIRING WALLBOARD

(75) Inventor: John T. DiGate, Westminster, MD (US)

(73) Assignee: Jeffrey S. Melcher, Bethesda, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/265,562

(22) Filed: Mar. 9, 1999

(51) Int. Cl.[7] ..... E04G 23/00

(52) U.S. Cl. ..... 52/514; 52/514.5; 52/DIG. 6; 52/715; 52/745.2; 52/745.13

(58) Field of Search ..... 52/514, 514.5, 52/712, 715, DIG. 6, 745.2, 745.13

(56) References Cited

U.S. PATENT DOCUMENTS

| | | | | |
|---|---|---|---|---|
| D. 391,149 | | 2/1998 | Gonzales . | |
| 523,359 | | 7/1894 | Leicht . | |
| 924,355 | | 6/1909 | Howard . | |
| 963,776 | | 7/1910 | Kosack . | |
| 2,236,082 | | 3/1941 | Wright . | |
| 2,261,510 | | 11/1941 | Atcheson . | |
| 2,317,428 | * | 4/1943 | Anderson | 52/514 |
| 2,340,249 | | 1/1944 | Murphy . | |
| 3,289,374 | * | 12/1966 | Metz | 52/514 |
| 3,359,701 | * | 12/1967 | Schneller | 52/712 |
| 3,936,913 | | 2/1976 | Weissman . | |
| 3,936,988 | * | 2/1976 | Miceli | 52/514 |
| 3,995,404 | | 12/1976 | Thaw . | |
| 4,152,877 | | 5/1979 | Green . | |
| 4,178,730 | * | 12/1979 | Rowinski | 52/514 |
| 4,297,823 | * | 11/1981 | Keisler | 52/514 |
| 4,523,412 | * | 6/1985 | Sielaff | 52/715 |
| 4,578,854 | | 4/1986 | Demeglio . | |
| 4,641,474 | * | 2/1987 | Cannarsa | 52/514 |
| 4,644,723 | | 2/1987 | Weber . | |
| 4,782,642 | | 11/1988 | Conville . | |
| 4,831,808 | | 5/1989 | Wynar . | |
| 4,995,605 | | 2/1991 | Conville . | |
| 5,619,836 | * | 4/1997 | Rouch et al. | 52/514 |
| 5,653,079 | | 8/1997 | Loeffler . | |
| 5,687,528 | | 11/1997 | Rouch . | |

* cited by examiner

*Primary Examiner*—Christopher T. Kent
*Assistant Examiner*—Dennis L. Dorsey
(74) *Attorney, Agent, or Firm*—Jeffrey S. Melcher; Farkas & Manelli

(57) ABSTRACT

Provided is a wallboard repair clip which includes a patch wallboard receiving structure for contacting inner and outer surfaces of a patch wallboard, an existing wallboard receiving member and a securing structure.

102 Claims, 24 Drawing Sheets

WALLBOARD REPAIR CLIP, METHOD OF REPAIRING WALLBOARD, AND KIT FOR REPAIRING WALLBOARD

1. FIELD OF THE INVENTION

This invention relates to a clip for repairing a hole in wallboard. The invention also relates to a method of repairing a hole in wallboard. The invention further relates a kit for repairing a hole in wallboard. The invention also relates to a method of accessing the interior of a hollow wall.

2. BACKGROUND OF THE INVENTION

It is generally known that modern day building construction techniques have been increasingly directed toward the use of wallboard panels to construct walls and partitions. The wallboard materials generally used are commonly referred to as drywall, gypsum board, plasterboard, wood paneling, and the like. The wallboards are usually connected to studs which are suitably spaced according to local building codes.

While the construction techniques of such hollow walls has provided advantages, they also have many disadvantages with respect to repairing holes. When patching a hole in the existing wallboard, the wallboard is cutout around the damage, and patch wallboard is inserted and the seams plastered over. Often, the hole is between the studs leaving nothing to keep the patch wallboard flush with the existing wallboard. A common method is to cut and remove a large section of the existing wallboard extending from stud to stud, and securing a patch wallboard to the studs. While this method facilitates a repair of the damaged wallboard, it nevertheless is expensive and wasteful. In addition, the nature of such a repair requires that the patch wallboard be of a thickness identical to that of the existing wallboard so as to provide a continuous surface at the periphery of the repair. Also, since some types of wallboard such as drywall are not constructed to withstand substantial bending forces, the flexing of the wallboard repair panel between the studs presents a problem due to the absence of structural supports within the span. In most applications, since the stud-to-stud distance is approximately 16 inches, this problem of patch wallboard can cause problems of discontinuity at the surfaces between the patch wallboard and the surrounding wallboard portions.

Several other methods have been used to hold the patch wallboard flush with the existing wallboard while applying the plaster. Another method is to cut a patch wallboard using drywall such that a flap of the paper is left around the edges. The patch wallboard is inserted in the hole and the paper flap is then plastered over. This method undesirably requires a significant amount of precise cutting and plastering over the paper flap is difficult. A further method involves mechanically fastening a fastener behind the hole to back the patch wallboard, which is time consuming, difficult to precisely align the backing, and requires that the patch wallboard be of the same thickness as the existing wallboard. There are also commercially available screens to use in the patching the wallboard.

Several attempts have been made to overcome these disadvantages. U.S. Pat. No. 3,995,404 (Thaw) discloses a clip for repairing drywall. The clip is mounted on the sides of the hole in the drywall being repaired by wallboard gripping members 18 and 20. The patch wallboard is then pushed into the hole being repaired. The patch is held in place by a retaining member 24 which digs into the plaster between the paper surfaces of the drywall and retaining member 22. The outer paper surface of the drywall patch is not contacted with a surface of the clip. This type of clip does not align the outer surfaces of the patch and existing wallboard on a common plane.

Design Patent No. 391,149 (Gonzales) discloses a clip for repairing drywall or gypsum wallboard. This clip has a prong which digs into the material between the paper surfaces. This type of clip aligns the patch and existing wallboard using the inner surfaces. Thus, the thicknesses of the patch and existing wallboards must exactly match in order to achieve a suitable repair.

U.S. Pat. No. 4,641,474 (Cannarsa) discloses a clip for joining wallboard. This clip retains the wallboard by using teeth which dig into the wallboard material. There is no structure for gripping opposing surfaces of the patch wallboard.

U.S. Pat. No. 4,644,723 (Weber) discloses a wallboard clip for repairing holes in wallboard. The wallboard clip contains no structure for gripping opposing surfaces of the patch wallboard.

U.S. Pat. No. 5,687,528 discloses a patch fastener device for a plasterboard wall. The fastener device mounts to one surface of the patch plasterboard and one surface of the existing plasterboard with the use of adhesive strips. The fastener device contains no structure for gripping opposing surfaces of the patch wallboard.

None of the conventional wallboard repair clips contact the inside and outside surfaces of the patch wallboard as well as the outside surface of the existing wallboard and the side surface of the existing wallboard being repaired to secure the patch wallboard inside the existing wallboard in all directions.

Furthermore, conventional clips do not easily align the outer surfaces of the patch wallboard and existing wallboard on a common plane.

Trades persons, such as electricians and plumbers, routinely access the interior of hollow walls to make repairs or new installations. Usually, the portion of the wallboard removed to access the interior of the hollow wall is discarded as undesirable waste. Furthermore, the repair of the hole formed is difficult and time consuming using the above described conventional wallboard repair clips and methods. Therefore, there is a need for an efficient method which reduces the amount of waste material, reduces the amount of time required to repair the hole, and reduces the level of skill necessary to repair the hole.

SUMMARY OF THE INVENTION

An objective of the present invention is to provide a wallboard clip which contacts the inside and outside surfaces of the patch wallboard as well as the side and outside surfaces of the wallboard being repaired to secure the patch wallboard to the existing wallboard such that the outer surface of the patch wallboard and the outer surface of the existing wallboard are aligned on substantially a common plane.

Another objective of the present invention is to provide a method of repairing a hole in a wallboard which reduces the amount of time.

A further objective of the present invention is to provide a method of accessing the interior of a hollow wall which reduces the amount of waste material and reduces the amount of time required to repair the hole.

The above objectives and other objectives are surprisingly obtained by a wallboard clip which is designed to be mounted on the patch wallboard first, instead of the existing wallboard, to capture both the outer and inner surfaces of the patch wallboard. The wallboard clip includes a securing structure which allows the patch wallboard containing the wallboard clips to be installed and once in the repaired position captures a side surface and an outer surface of the existing wallboard. The wallboard clip secures the patch wallboard in the correct position with the outer surface of the patch wallboard and the existing wallboard being flush, regardless of the thickness of the patch wallboard or the existing wallboard. Thus, the wallboard clip simplifies and significantly reduces the time required to repair a hole in an existing wallboard, and provides a superior connection between the patch wallboard and existing wallboard.

The present invention provides a novel wallboard clip for securing a patch wallboard to an existing wallboard to repair the existing wallboard. The wallboard clip comprises:

patch wallboard receiving structure constructed and arranged to receive a patch wallboard so as to capture a peripheral portion of inner and outer opposing surfaces of the patch wallboard;

an existing wallboard gripping member constructed and arranged to contact of peripheral portion of an outer surface of an existing wallboard to be repaired, the existing wallboard gripping member being coupled to the patch wallboard receiving structure such that the peripheral portion of the outer surface of the patch wallboard and the peripheral portion of the outer surface of the existing wallboard are arranged substantially in a common plane when the patch wallboard is in a repaired position within the existing wallboard; and securing structure coupled to the existing wallboard gripping member, the securing structure being constructed and arranged to grip a side surface of the existing wallboard such that when the patch wallboard is in a repaired position within the existing wallboard, a side surface and outer peripheral surface of the existing wallboard are captured to secure the patch wallboard in the repaired position.

Also provided is a novel method of making a wallboard clip for securing a patch wallboard to an existing wallboard to repair the existing wallboard. The method comprises:

a) providing a metal strip having opposing first and second ends, opposing first and second surfaces, and an axis along the length of the metal strip;

b) forming a securing structure constructed and arranged such that said securing structure grips a side of the existing wallboard and secures the existing wallboard when the patch wallboard is in a repaired position within the existing wallboard, c) cutting the first end of the metal strip substantially in a direction of the axis to form first and existing wallboard gripping members;

d) bending the first gripping member in a first direction to form about a 90° angle or less in relation to the axis;

e) bending the existing wallboard gripping member in a second direction substantially opposite to the first direction to form about a 90° angle or less in relation to the axis such that inner surfaces of the first and existing wallboard gripping members form about a 180° angle or less; and f) bending a portion of the second end of the metal strip about 90° in relation to the axis in the first direction to provide a second gripping member, wherein a body member being defined by a portion of the metal strip defined between the first and second gripping members;

wherein a distance between an inner surface of the first gripping member and an inner surface of the second gripping member is about the thickness of a patch wallboard such that the inner surfaces of the first and second gripping members are capable of capturing a peripheral portion of the inner and outer surfaces of the patch wallboard, and wherein an inner surface of the existing wallboard gripping member and the inner surface of the first gripping member are constructed and arranged such that when the patch wallboard is in a repaired position peripheral portions of the outer surfaces of the existing wallboard and the patch wallboard are on substantially a common plane.

The present invention also provides a novel method of repairing a hole in an existing wallboard. The method comprises:

a) providing a patch wallboard having a surface area larger than a hole to be repaired in the existing wallboard;

b) tracing an outline of the patch wallboard on the existing wallboard which surrounds the hole to be repaired;

c) cutting out the trace on the existing wallboard;

d) inserting at least two wallboard clips onto the patch wallboard such that peripheral portions of the inner an outer surfaces of the patch wallboard are captured by the patch wallboard receiving structure; and e) inserting the patch wallboard containing the wallboard clips into the hole until the patch wallboard reaches a repaired position in which peripheral portions of the inner surfaces of the existing wallboard and existing wallboard are on substantially a common plane.

The present invention further provides a novel method of accessing the interior of a hollow wall comprising:

cutting a hole in an existing wallboard, wherein a patch wallboard is defined by the cut;

removing the patch wallboard from the existing wallboard;

applying a plurality of wallboard clips to peripheral portions of the patch wallboard; and inserting the patch wallboard containing wallboard clips into the hole such that the wallboard clips secure the patch wallboard within the existing wallboard.

The present invention also provides a patch wallboard for repairing a hole in existing wallboard comprising:

a patch wallboard; and a plurality of wallboard clips mounted around a periphery of the patch wallboard. The wallboard clips are constructed and arranged to capture a side surface and an outer peripheral portion of an existing wallboard when the patch wallboard is in an installation position within the existing wallboard.

The present invention has the advantage that any size hole can easily be repaired. As the size the patch wallboard and hole increase, the number of wallboard clips or size of the wallboard clips can be increased. Generally, he greater the size of the patch wallboard and hole, the greater the number of wallboard clips required.

The present invention also has the advantage that the thickness of the existing wallboard and patch wallboard do not have be matched to provide a suitable patch. Since the outer surfaces of the existing wallboard and patch wallboard are aligned, one size of wallboard clip can be used to repair any thickness of existing wallboard.

Furthermore, the present invention is capable of providing the original fire wall protection by replacing the original existing wallboard and using a non-flammable material for forming the wallboard clip.

DETAILED DESCRIPTION OF INVENTION

Figure 1:
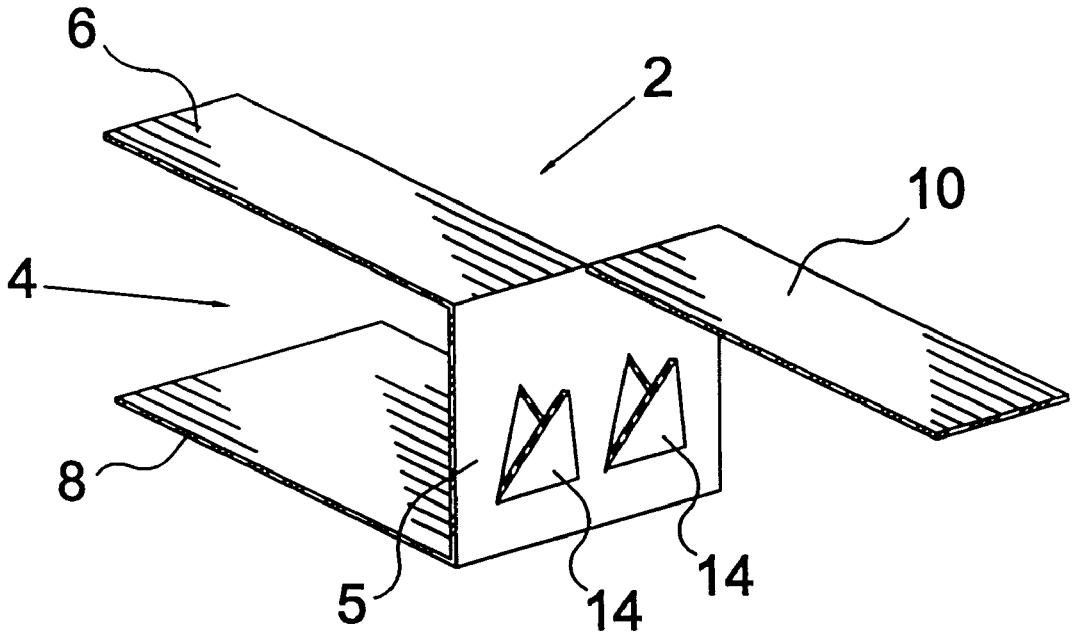
FIG. 1 illustrates a view of a wallboard clip according to the present invention.

The invention will be explained with reference to the attached Figures. As shown in FIGS. 1 through 6, the wallboard clip 2 includes a body member 5. A patch wallboard receiving structure 4 is coupled to the body member 5. The wallboard receiving structure 4 is constructed and arranged to receive a patch wallboard so as to capture a peripheral portion of the inner and outer opposing surfaces of the patch wallboard. Thus, when the wallboard clip 2 is mounted on the patch wallboard, the wallboard receiving structure 4 holds the wallboard clip 2 in place during installation and secures the patch wallboard to the existing wallboard when the patch wallboard is in the repaired position. The patch wallboard receiving structure includes a first gripping member 6 which is constructed to contact a peripheral portion of the outer surface of the patch wallboard and a second gripping member 8 which is constructed to contact the peripheral portion of the inner surface of a patch wallboard. The inner surfaces of the first gripping member 6 and the second gripping member 8 are spaced apart about the thickness of the patch wallboard. The inner surfaces of the first gripping member 6 and the second gripping member 8 can be substantially parallel as shown in FIGS. 1–5. Alternatively, the first gripping member 6 can slope towards the second gripping member 8, as shown in FIG. 6 at 16.

An existing wallboard gripping member 10 is coupled to the body member 5 and is constructed and arranged to contact of peripheral portion of an outer surface of the existing wallboard to be repaired. The existing wallboard gripping member 10 should be coupled to the patch wallboard receiving structure 4 such that the inner surface of the first gripping member 6 and the inner surface of the existing wallboard gripping member 10 form an angle of about 180°, as shown in FIG. 1. In this manner, the peripheral portions of the outer surface of the patch wallboard and the outer surface of the existing wallboard will be arranged substantially in a common plane when the patch wallboard is secured in the repaired position within the existing wallboard. Alternatively, the first gripping member 6 and the existing wallboard gripping member 10 can be constructed to form an angle less than 180° as shown in FIG. 6 at 16 to provide tension against the peripheral portions of the patch wallboard and the existing wallboard captured by the wallboard clip. Examples of suitable angles are between about 1 to about 20° less than 180°, preferably about 2 to about 10° less than 180°. However, if desired, the first and existing wallboard gripping members 6 and 10 can be formed at any angle and then adjusted by the end user prior to application of the wallboard clip to the patch wallboard and existing wallboard. When the peripheral portions of the patch wallboard and the existing wallboard are captured by the wallboard clip 2, the first gripping member 6 and the existing wallboard gripping member 10 will flex such that the inner surfaces of the first gripping member 6 and the existing wallboard gripping member 10 form an angle of about 180° and are substantially on a common plane. In this manner, the peripheral portions of the patch wallboard and the existing wallboard captured by the wallboard clip 2 are aligned on substantially a common plane, regardless of the thicknesses of the patch wallboard and the existing wallboard.

The exposed outer surface of the wallboard clip 2, including the exposed outer surfaces of the first gripping member 6 and the existing wallboard gripping member 10, should be suitable for concealing by conventional wallboard patching techniques, for example, by taping plastering, joint compound, spackling, and/or painting techniques. In this regard, the exposed outer surface should be substantially free of large ridges, bumps or other protrusions, which are capable of causing undesirable protrusions when covered by conventional taping and spackling techniques. Preferably, the exposed outer surfaces of first gripping member 6 and the existing wallboard gripping member 10 are substantially on a common plane when said patch wallboard is in a repaired position within the existing wallboard to further enhance concealing by conventional patching techniques. The exposed outer surfaces of the wallboard clip can have small ridges, bumps or other protrusions which are capable of being concealed by conventional taping and spackling techniques. If such small protrusions are present, they should be about ⅛ inch or less, preferably about 0.05 inch or less in height. Preferably, the thickness of the first gripping member 6 and the existing wallboard gripping member 10 is sufficiently thin to be concealed by conventional taping and spackling techniques. Suitable thickness have been found to be about ⅛ inch or less, more preferably about 0.05 inch or less, and most preferably about 0.02 inch or less.

The wallboard clip 2 further includes a securing structure shown generally at 12 which is constructed and arranged to grip a side surface of an existing wallboard. As shown in FIG. 1, the securing structure 12, includes at least one spur 14. The spur 14 is constructed and arranged such that the spur slides along the side surface of the existing wallboard during installation of the patch wallboard into the existing wallboard, and prevents the patch wallboard from being removed when the patch wallboard is in the repaired position. In this manner, the patch wallboard is secured within the existing wallboard. The spur 14 can be pointed as shown in FIG. 6, but can also have other shapes generally used for securing. The spur 14 should be arranged such that a gripping portion of the spur digs into the side of the existing wallboard and inhibits or prevents the patch wallboard from being removed. One skilled in the art will easily be able to adapt well known spur shapes for use in the clip 2 according to the present invention. Besides the spur 14 shape shown, examples of suitable shapes are teeth, spikes and barbs.

Figure 7:
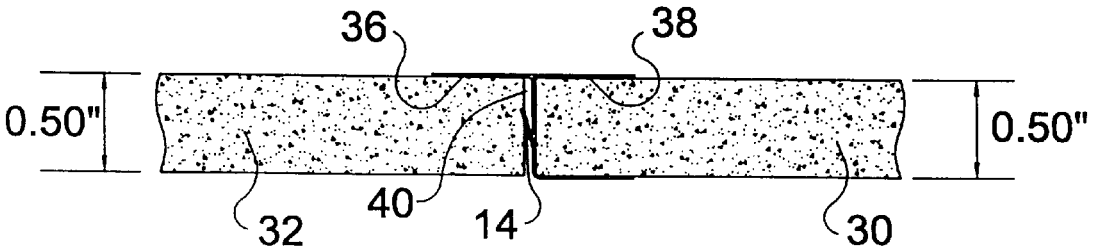
FIG. 7 illustrates a cut away side view of a patch wallboard secured in a repaired position within an existing wallboard according to the present invention.
Figure 20:
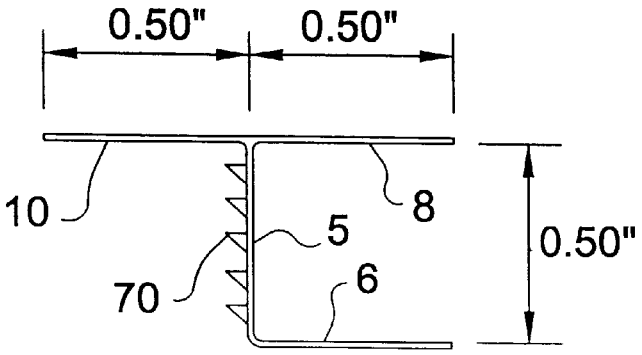
FIG. 20 illustrates a view of a wallboard clip having an alternative securing structure.
Figure 21:
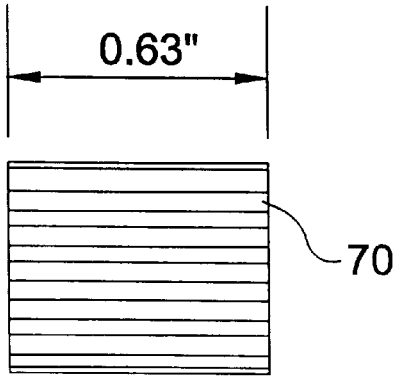
FIG. 21 illustrates a view of a wallboard clip having an alternative securing structure.
Figure 22:
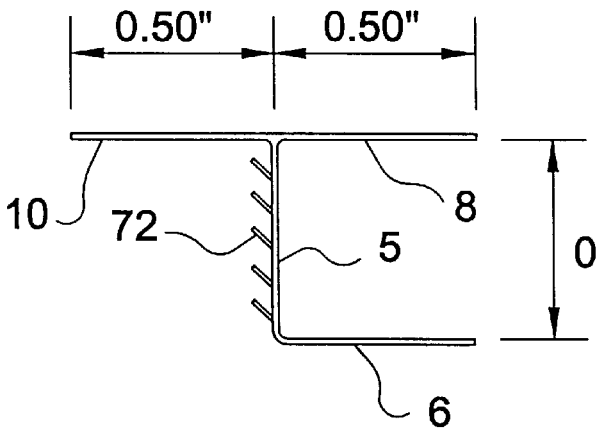
FIG. 22 illustrates a view of a wallboard clip having an alternative securing structure.
Figure 23:
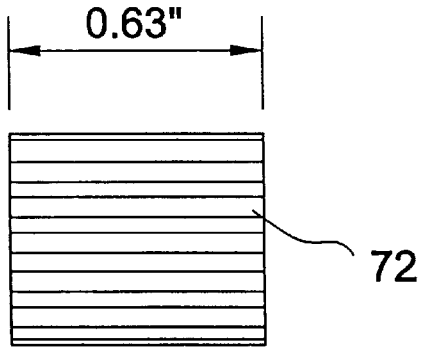
FIG. 23 illustrates a view of a wallboard clip having an alternative securing structure.
Figure 24:
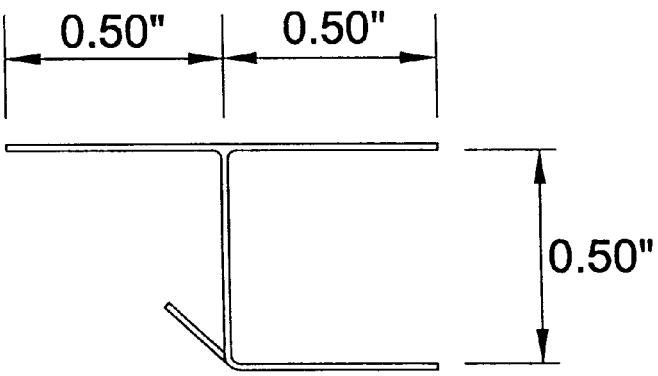
FIG. 24 illustrates a view of a wallboard clip having an alternative securing structure.
Figure 25:
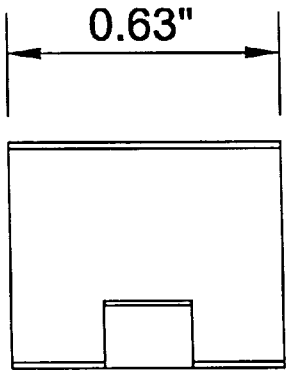
FIG. 25 illustrates a side view of a wallboard clip having an alternative securing structure.
Figure 26:
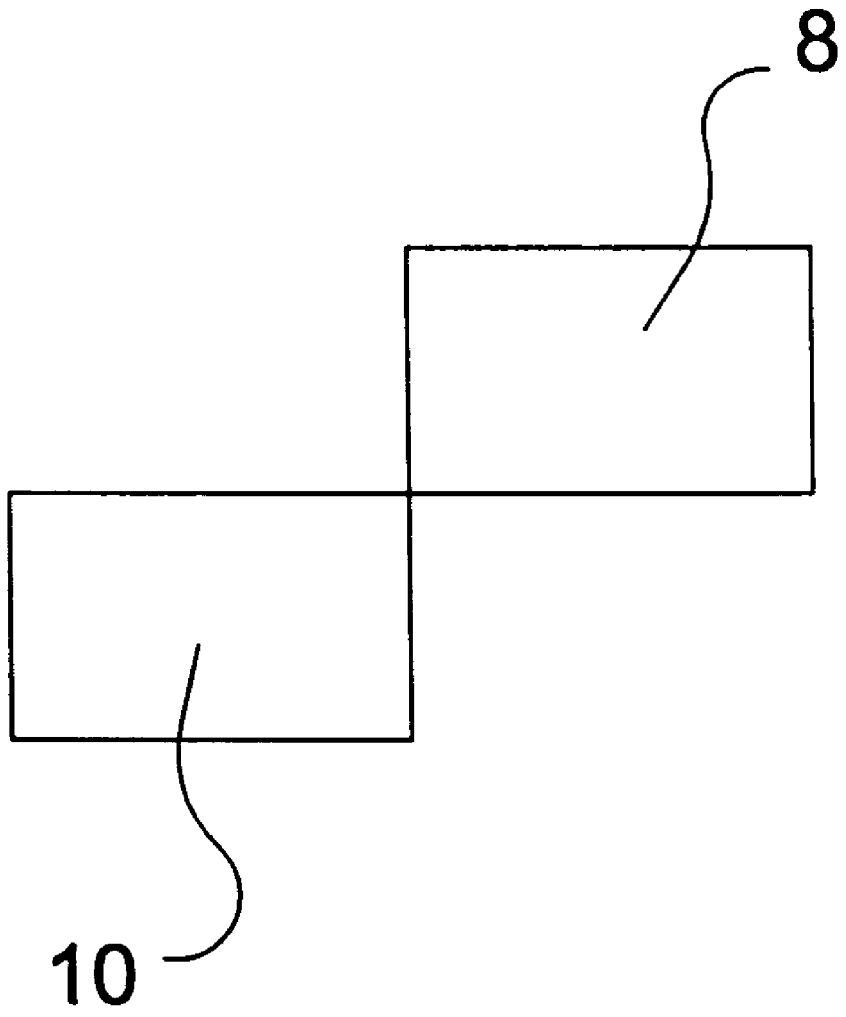
FIG. 26 illustrates a view of a wallboard clip having an alternative securing structure.

Based on the disclosure provided herein, one skilled in the art will be able to adapt conventional structures and methods for gripping a surface for use as the securing structure in the wallboard clips described herein. The securing structure can be constructed and arranged such that only the outer exposed surface of the side surface of the existing wallboard is contacted and gripped, and/or such that the securing structure digs into the side surface of the existing wallboard as shown in FIG. 7. Examples of suitable alternative securing structures are shown in FIGS. 20 through 28. FIGS. 20 and 21 illustrate the use of a plurality of ridges 70 as the securing structure. The ridges 70 are designed such that there is less friction or resistance in the installation direction than the opposing direction. FIGS. 22 and 23 illustrate the use of flexible ridges 72 to provide less friction or grip in the installation direction than the opposing direction. The ridges shown in FIGS. 22 and 23 can easily be formed by well known extrusion techniques using conventional materials, such as plastics and metals, or by press forming a metal strip. FIGS. 24 and 25 illustrate a securing structure 74 which is coupled to an end of the body member instead of a surface of the body member. FIG. 26 illustrates how the gripping members can be formed.

Figure 27:
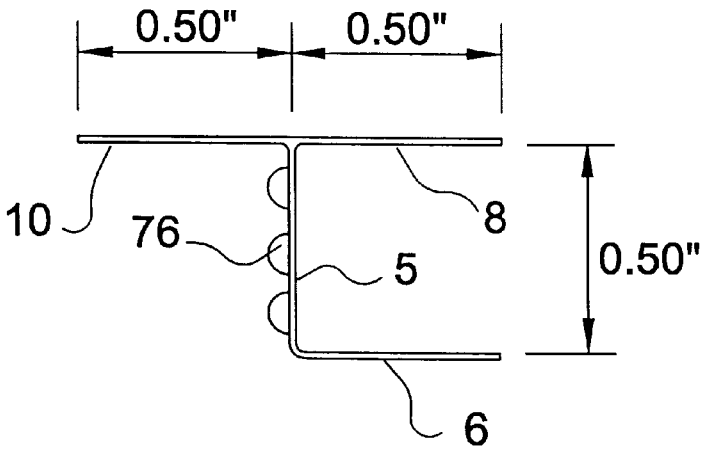
FIG. 27 illustrates a view of a wallboard clip having an alternative securing structure.
Figure 28:
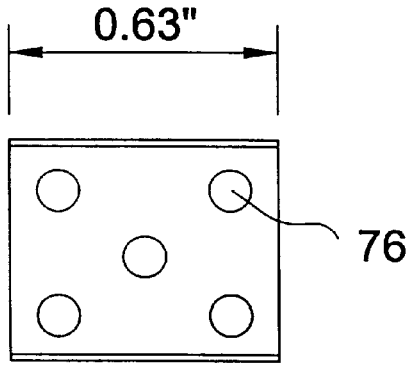
FIG. 28 illustrates a view of a wallboard clip having an alternative securing structure.

The securing structure is preferably constructed such that less friction or grip against the side of the existing wallboard is present when force is applied in the installation direction than in the opposing direction. In this manner, once the patch wallboard is in the repaired position, the securing structure will secure the patch wallboard in the installed position. However, if desired, the securing structure can be constructed such that the patch wallboard is easily removable by providing a securing structure which functions mainly by friction against the side surface of the existing wallboard instead of mainly by digging into the side surface of the existing wallboard. Examples of suitable securing structure which mainly provide friction and avoid substantial digging into the side surface include bumps 76 or ridges 78 on the body member 5, as shown in FIGS. 27 and 28. For example, the bumps 76 or ridges 78 can be formed from a polymeric material or formed by deforming or extruding the material used to form the wallboard clip. While not preferred, if desired, an adhesive can be incorporated for use in the securing structure.

Figure 39:
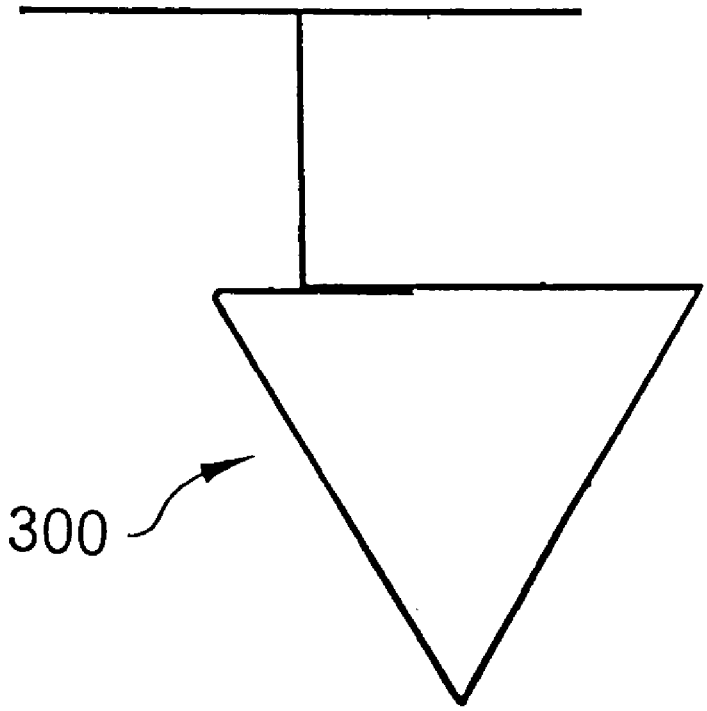
FIG. 39 illustrates a locking structure that is suitable for use in the present invention.

If desired, as shown in FIG. 39, to the securing structure 12, a locking structure 300 as described in my copending U.S. patent application Ser. No. 09/231,775, incorporated herein by reference, can also be incorporated on the wallboard clip 2, such that both the securing structure 12 and the locking structure 300 of my copending application can be used in tandem.

The distance between the inner surfaces of the first gripping member 6 and the second gripping member 8 should be about the thickness of the patch wallboard to provide a secure fit when the wallboard clip 2 is installed on the patch wallboard. The distance will depend on the type of wallboard material utilized. For example, for drywall which has a compressible paper surface the distance can range from about 1/16 inch less than the thickness of the drywall to the thickness of the drywall. Alternatively, if the inner surface of the first gripping member 6 is sloped towards the inner surface of the second gripping member as shown in FIG. 6, during installation of the wallboard clip 2 onto the patch wallboard, the first gripping member 6 can flex away from the second gripping member 8 providing tension between the inside surfaces of the gripping members 6 and 8 and opposing peripheral portions of the patch wallboard there between. The wallboard clip 2 can be constructed and dimensioned to capture any size patch wallboards and existing wallboards as desired. Common sizes are ⅜ inch, ½ inch, ⅝ inch and 1 inch.

Figure 2:
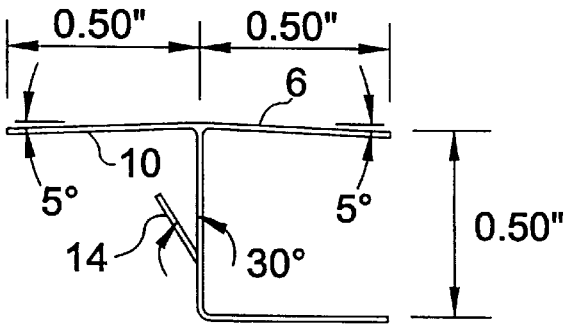
FIG. 2 illustrates a view of a wallboard clip according to the present invention.
Figure 3:
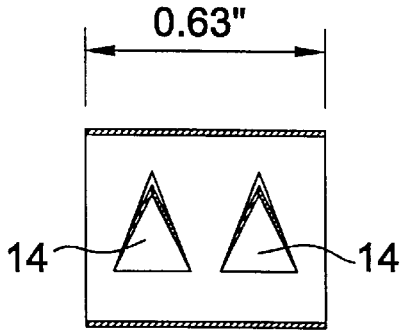
FIG. 3 illustrates a view of a wallboard clip according to the present invention.

FIGS. 2, 3 and 6 illustrate a patch wallboard receiving structure 4 which is sized to capture a ½ inch patch wallboard.

Figure 4:
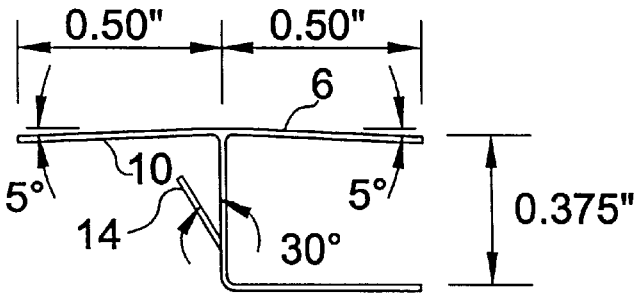
FIG. 4 illustrates a view of a wallboard clip according to the present invention.
Figure 5:
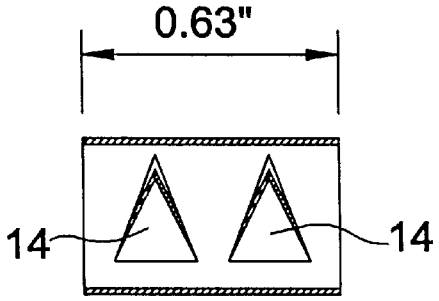
FIG. 5 illustrates a view of a wallboard clip according to the present invention.
Figure 6:
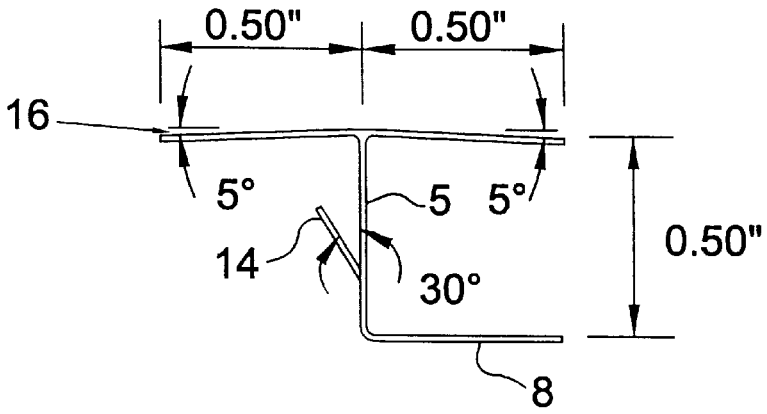
FIG. 6 illustrates a view of a wallboard clip according to the present invention.

FIGS. 4 and 5 illustrate a patch wallboard receiving structure 4 which is sized to capture a ⅜ inch patch wallboard.

Figure 8:
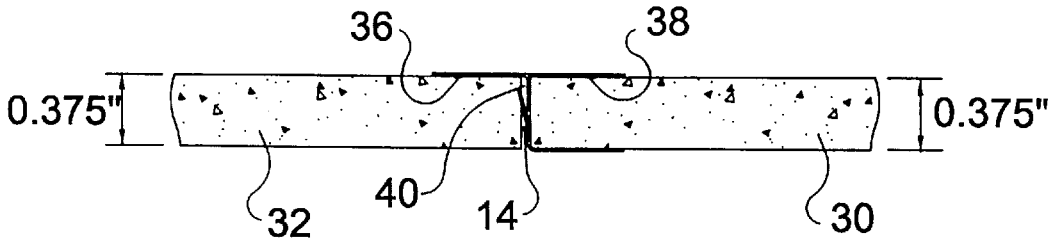
FIG. 8 illustrates a cut away side view of a patch wallboard secured in a repaired position within an existing wallboard according to the present invention.

As shown in FIGS. 7 and 8, when the patch wallboard 30 is in a repaired position within the existing wallboard 32, the spur 14 grips a side surface 40 of the existing wallboard 32 and secures the patch wallboard 30 within the existing wallboard 32. The peripheral portion of the outer surface of the patch wallboard 38 and the peripheral portion of the outer surface of the existing wallboard 36 are substantially on a common plane.

Figure 9:
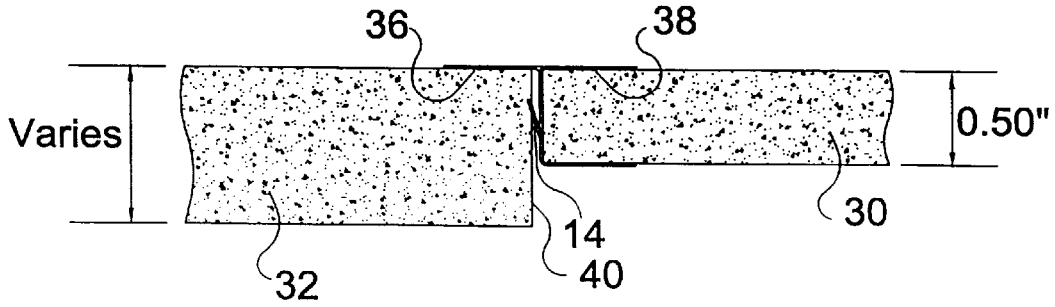
FIG. 9 illustrates a cut away side view of a patch wallboard secured in a repaired position within an existing wallboard according to the present invention.
Figure 10:
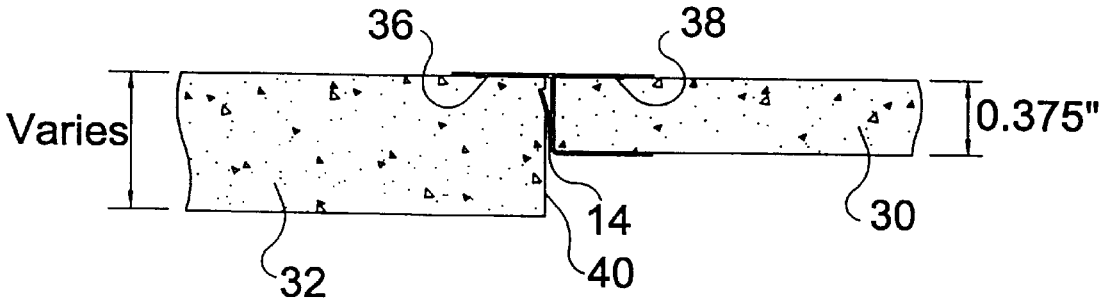
FIG. 10 illustrates a cut away side view of a patch wallboard secured in a repaired position within an existing wallboard according to the present invention.
Figure 11:
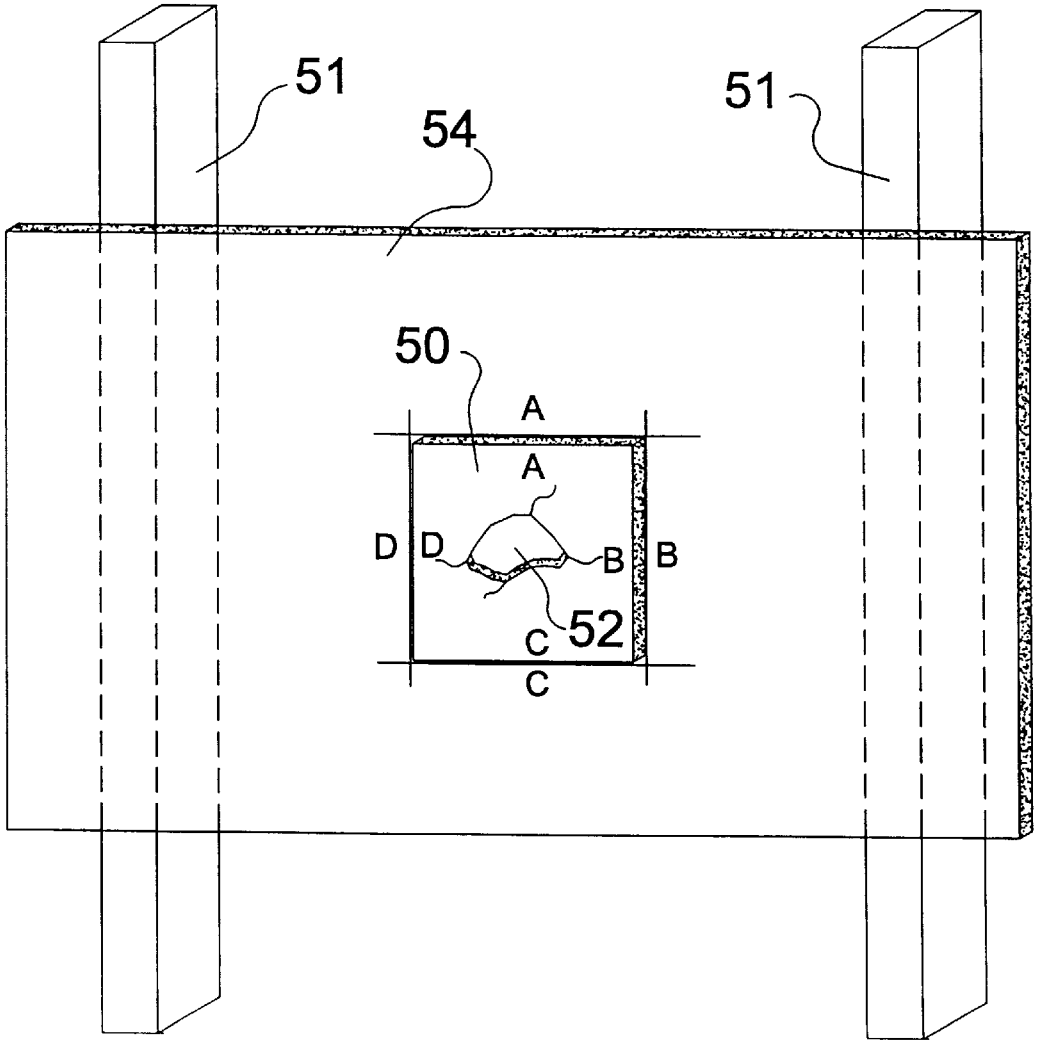
FIG. 11 illustrates a step of repairing a hole in an existing wallboard according to the present invention.

FIGS. 9 and 10 demonstrate that the wallboard clip 2 can be used to secure a patch wallboard 30 within any thickness existing wallboard 32.

Figure 12:
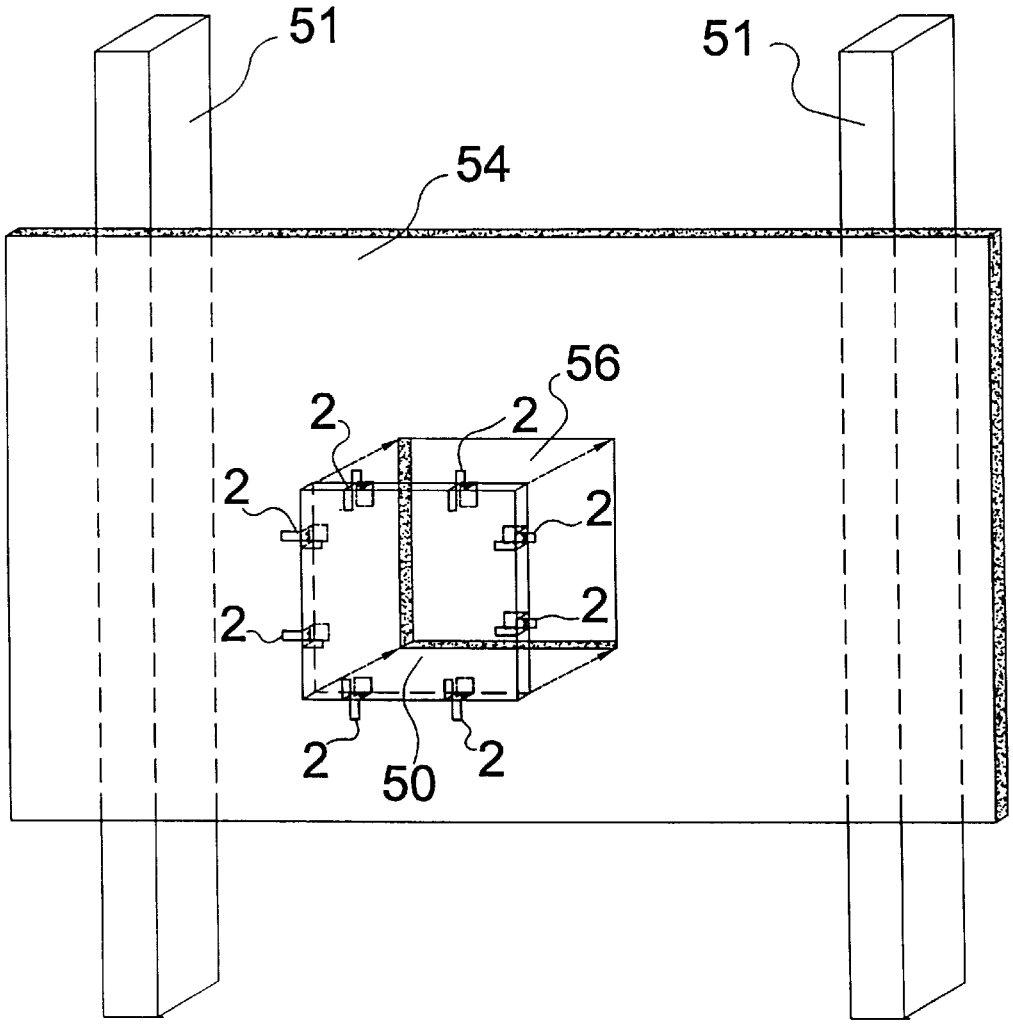
FIG. 12 illustrates a step of repairing a hole in an existing wallboard according to the present invention.
Figure 13:
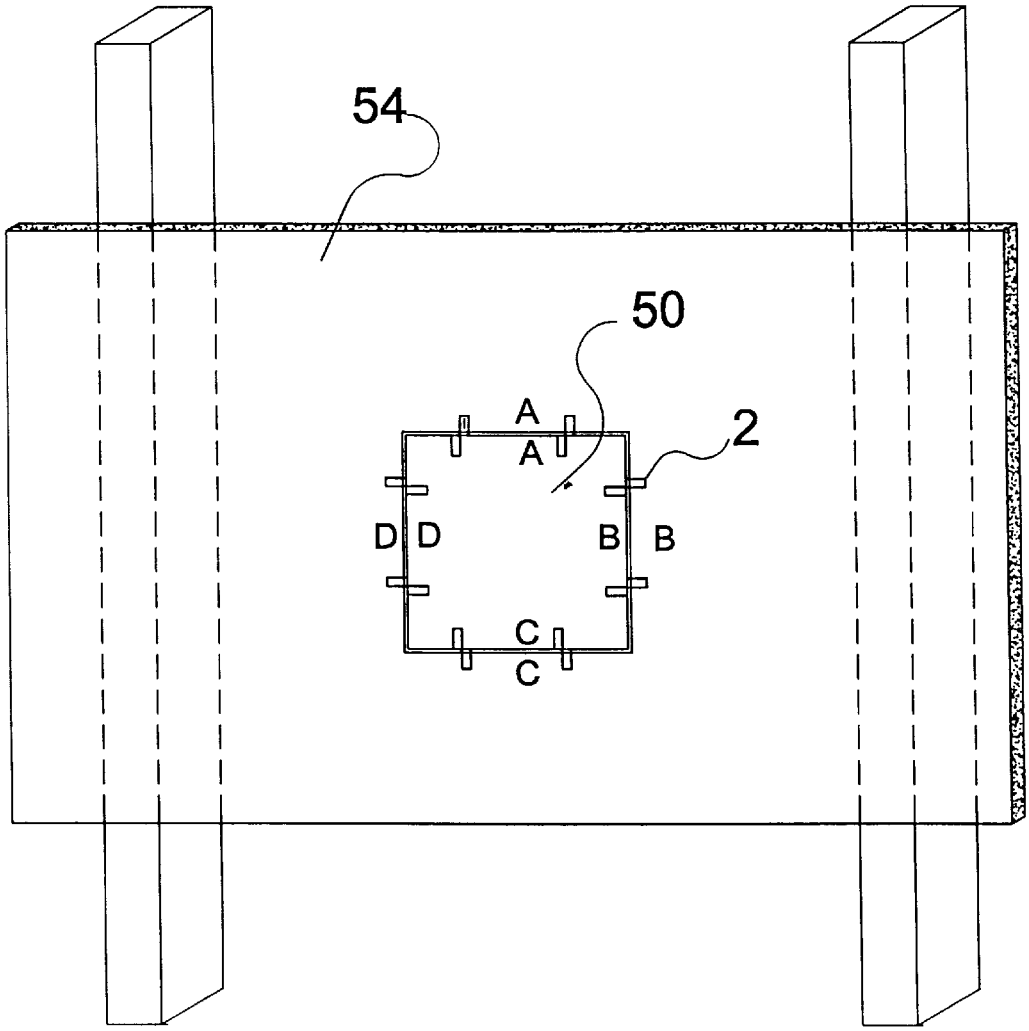
FIG. 13 illustrates a step of repairing a hole in an existing wallboard according to the present invention.
Figure 14:
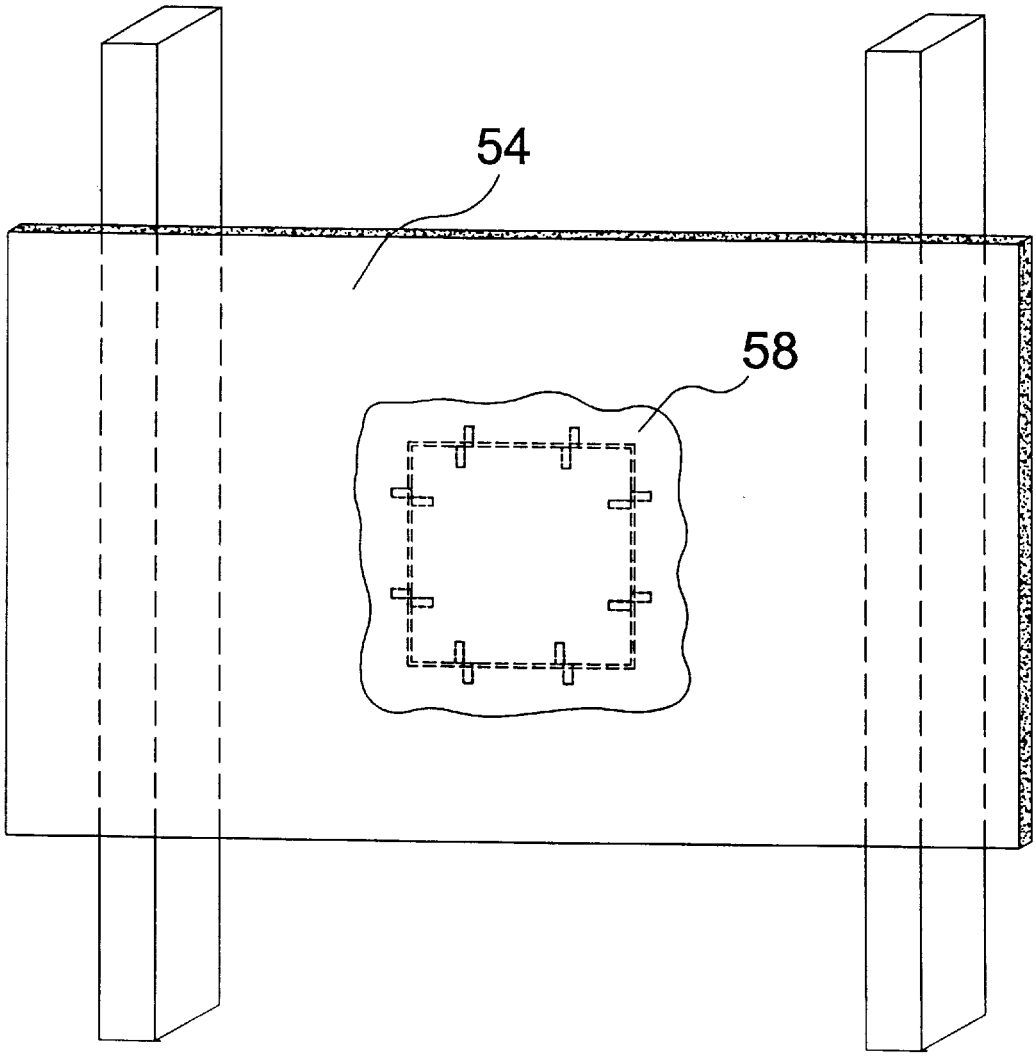
FIG. 14 illustrates a step of repairing a hole in an existing wallboard according to the present invention.

The wallboard clip 2 can be used to repair a hole 52 in existing wallboard 54 between studs 51, as shown in FIGS. 11 through 14. A patch wallboard 50 having a surface area greater than the hole 52 is provided. The patch wallboard 50 preferably has a square or rectangular shape for simplification, although any shape can be utilized as desired. The patch wallboard 50 is placed over the hole 52 and the shape of the patch wallboard 50 is inscribed on the surface of the existing wallboard 54. A hole 56 is then cut in existing wallboard 54 in the shape of the inscription such that the patch wallboard 50 fits within the hole 56. Wallboard clips 2 are then mounted on the patch wallboard 50. Preferably, at least one wallboard clip 2 is mounted on each side of the patch wallboard 50. The patch wallboard 50 having the wallboard clips 2 mounted thereon is then pushed into the hole 56 until a peripheral portion of the outer surface of the existing wallboard 54 contacts the existing wallboard gripping member 10 of the wallboard clip 2 as shown in FIG. 13, at which point the securing structure 12 grips a side surface of the existing wallboard 54 to secure the patch wallboard 50 in a repaired position. However, the patch wallboard 50 may move slightly past the repaired position during installation in which the existing wallboard gripping member 10 will flex and when pressure is released by the user, the existing wallboard gripping member 10 pulls the patch wallboard 50 back into a repaired position in which the existing wallboard gripping member 10 grips, and may dig into, the side surface of the existing wallboard 54. The wallboard clips 2 ensure that a flush outer surface is obtained between the peripheral portions of the patch wallboard 50 and the existing wallboard 54 irrespective of the thickness of the patch wallboard 50 or the existing wallboard 54 once the patch wallboard 50 is in a repaired position. Once the patch wallboard 50 is in a repaired position, the joints between the patch wallboard 50 and the existing wallboard 54 and the first and existing wallboard gripping members 6 and 10 can be covered by an any conventional method, such as by using joint tape and/or plaster 58. The present invention is not limited to repairing a hole between studs. The present invention may also be used to repair a hole exposing one or more studs.

Figure 15:
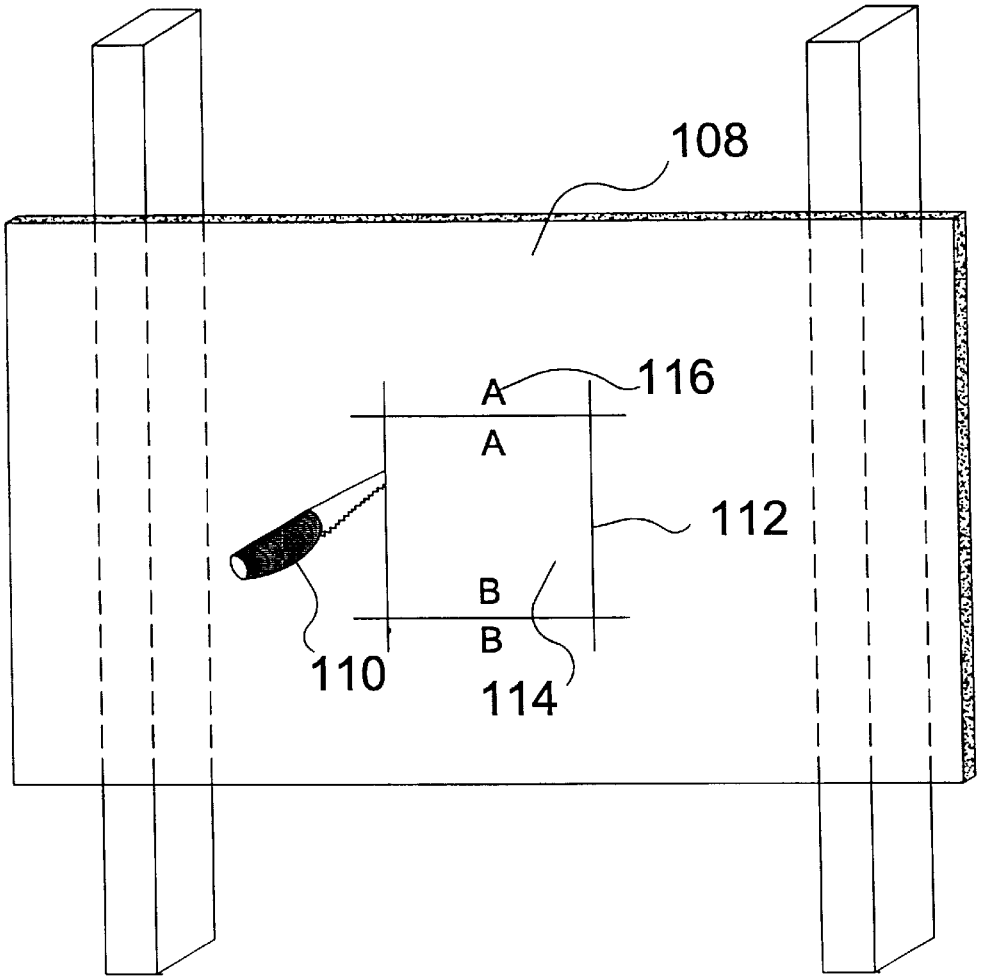
FIG. 15 illustrates a cutout being formed in existing wallboard for access to an interior of a hollow wall.
Figure 16:
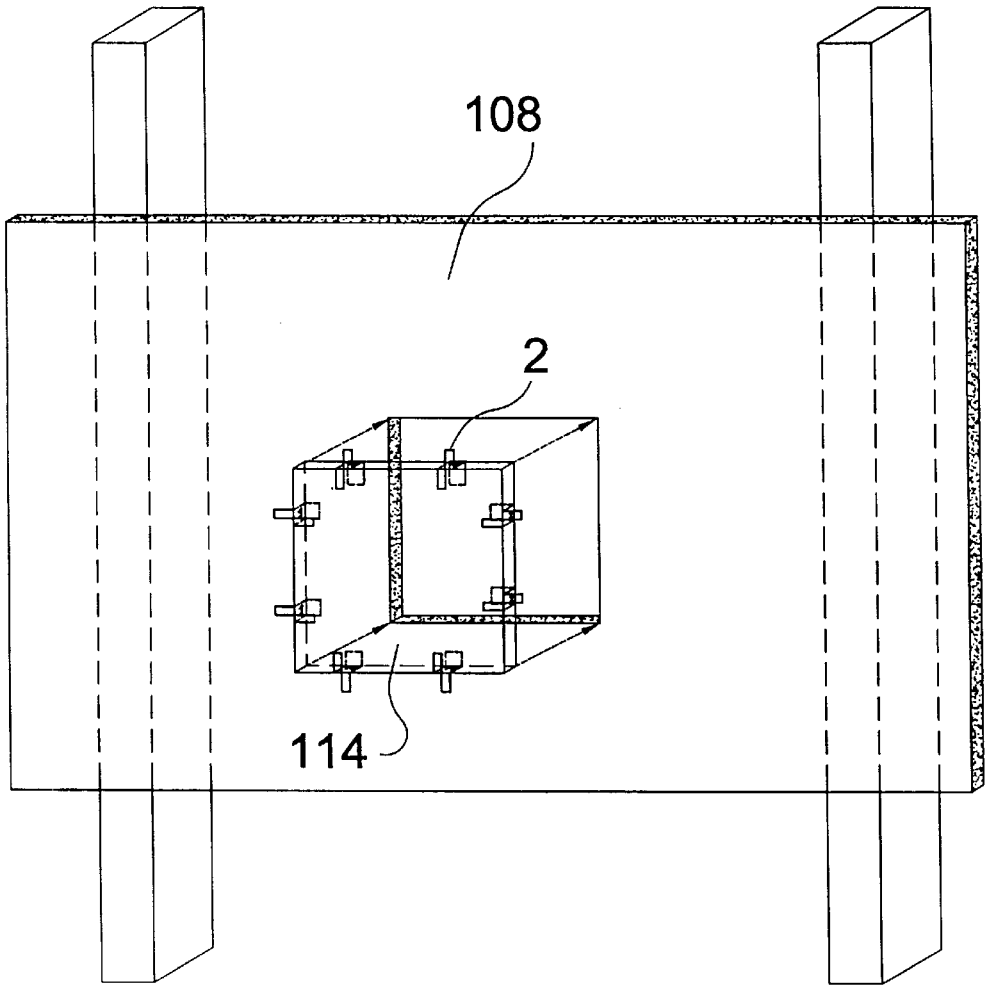
FIG. 16 illustrates wallboard clips being attached to the patch wallboard formed by the cutout.
Figure 17:
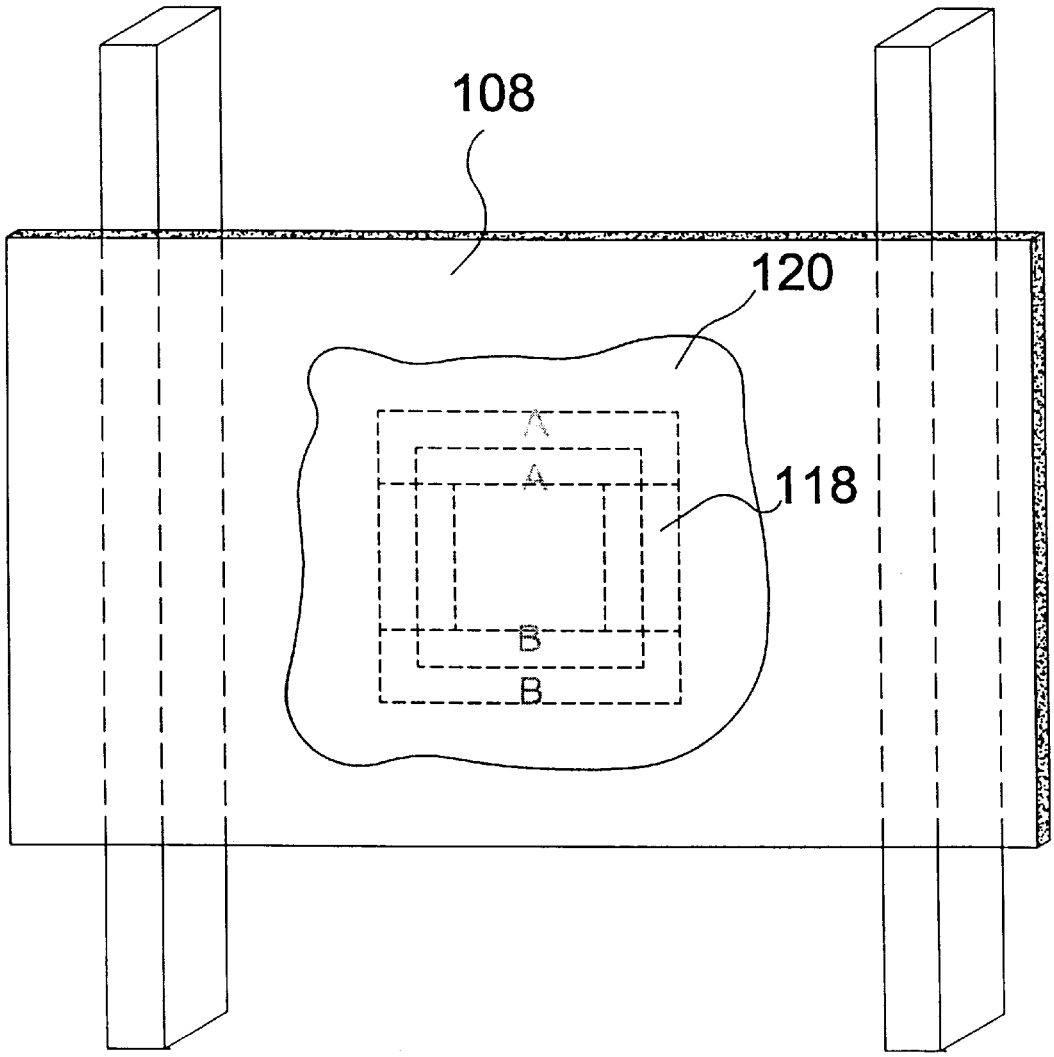
FIG. 17 illustrates the patch wallboard secured in a repaired position within the existing wallboard and then coated with tape and spackle.

The present invention also provides a novel method of accessing an interior of a hollow wall, as shown in FIGS. 15 through 17. Trades persons, such as electricians and plumbers, routinely require access to the interior of hollow walls to make repairs or for new installations. A hole having any desired size or shape can be cut in the wall to access the interior of the wall. The cut is preferably formed using a thin knife or saw, as shown in FIG. 15.

For example, when the wallboard comprises drywall 108, a thin drywall knife 110 can be used to cut out the shape 112 of the hole and then the portion of the wallboard 114 defined by the cut can be removed. Once access to the hollow wall is no longer needed, the hole can be repaired by using the portion of the wallboard 114 removed as the patch wallboard in the manner shown in FIGS. 12 through 14. A reference mark 116 is preferably made on the portion of the wallboard removed 114 and the existing wallboard 108 to ensure that the portion of the wallboard removed 114 is inserted in the correct position. In this manner, waste wallboard material from accessing the interior of a hollow wall can be avoided. FIG. 16 illustrates the wallboard clips 2 mounted on the periphery of the portion of wallboard 114 removed (now referred to as a patch wallboard 114). FIG. 17. illustrates the patch wallboard 114 installed in the existing wallboard 108. The wallboard clips 2 and the cutout are concealed by the joint tape 118 and the spackle 120.

The novel wallboard clips 2 can also be used along joints between wallboard to secure one wallboard to another.

The present invention further includes a kit for repairing a hole in existing wallboard. The kit includes a plurality of wallboard repair clips w and a patch wallboard. The kit optionally includes joint tape and joint compound, such as plaster or spakling, for covering the joint between the patch wallboard and the existing wallboard. The kit can also contain a tool for cutting a hole in the existing wallboard, such as a knife 110 or saw.

Figure 18:
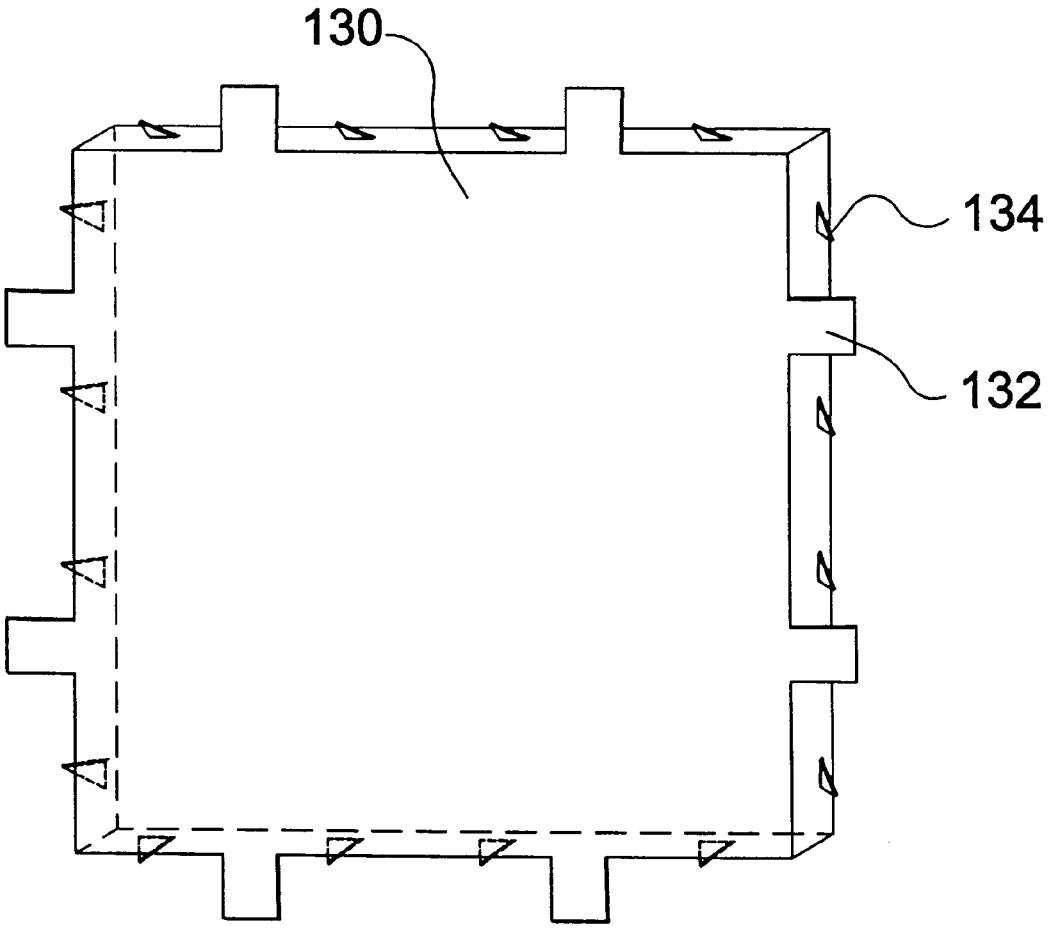
FIG. 18 illustrates a patch wallboard having integrally formed wallboard clips.
Figure 19:
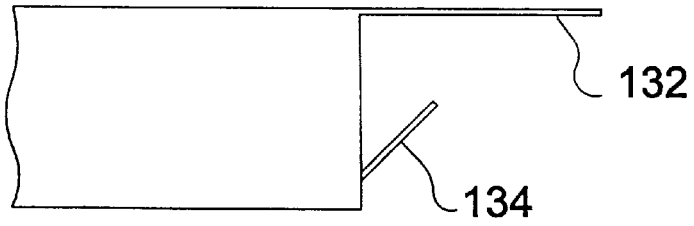
FIG. 19 illustrates a side view of the patch wallboard having integrally formed wallboard clips.

The present invention also provides a novel patch wallboard containing a plurality of wallboard clips around the periphery of the patch wallboard for securing the patch wallboard to a hole in an existing wallboard, such as the patch wallboard 50 containing wallboard clips 2 shown in FIG. 12. Alternatively, the wallboard clips can be integrally formed with the patch wallboard 130 as shown in FIGS. 18 and 19. The patch wallboard 130 containing integrally formed wallboard clips can be formed from any suitable material, such as metal, plastic, fiberglass, and combinations thereof. The integrally formed wallboard clips include an existing wallboard gripping member 132 and a securing structure 134. In general, the existing wallboard gripping member 132 and the securing structure 134 are constructed and arranged in a similar manner to the existing wallboard gripping member 10 and securing structure 12 described above except that the existing wallboard gripping member 10 and the securing structure 12 are integrally formed or connected to the patch wallboard instead of a body member. The existing wallboard gripping member 132 is preferably constructed such that a peripheral portion of the existing wallboard captured by the existing wallboard gripping member 132 is substantially on a common plane with a peripheral portion of the patch wallboard 130.

Figure 29:
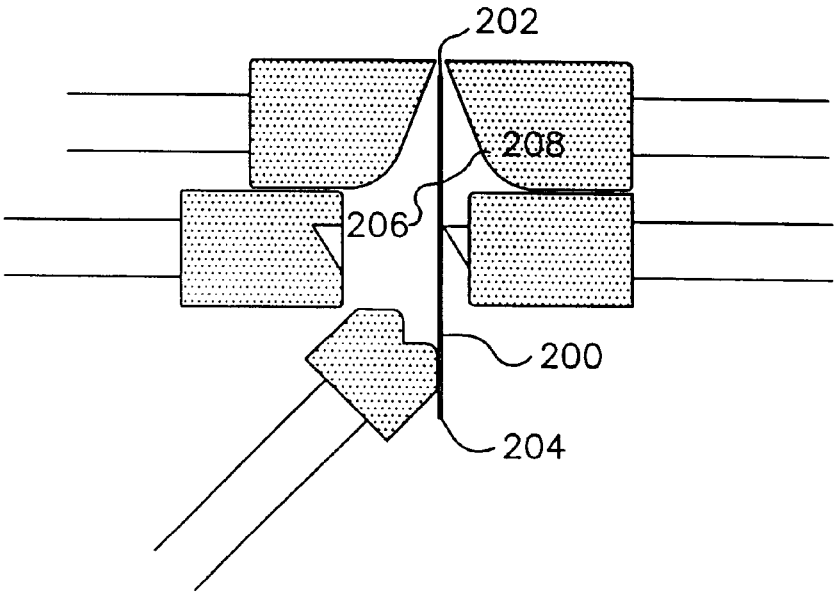
FIG. 29 illustrates a step in a method of making a wallboard clip.
Figure 30:
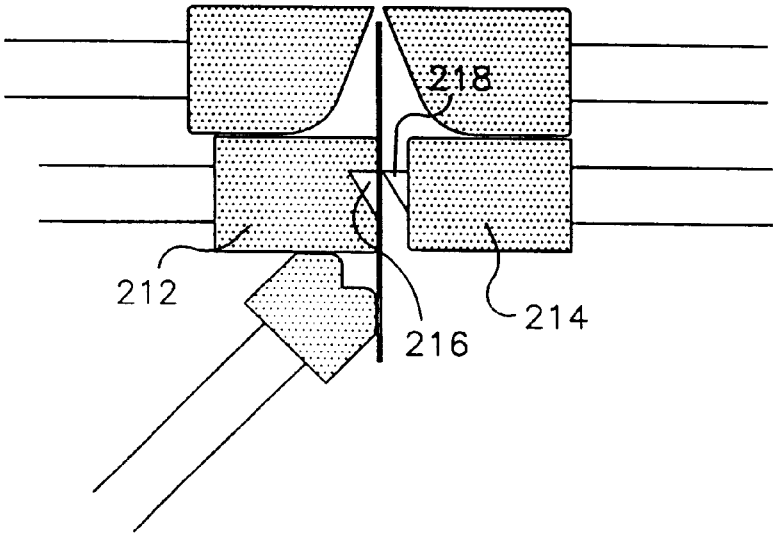
FIG. 30 illustrates a step in a method of making a wallboard clip.
Figure 31:
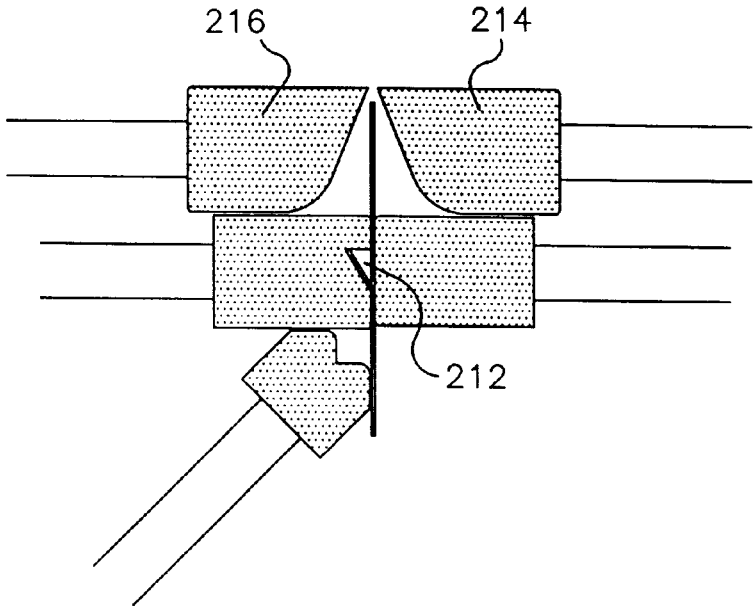
FIG. 31 illustrates a step in a method of making a wallboard clip.
Figure 32:
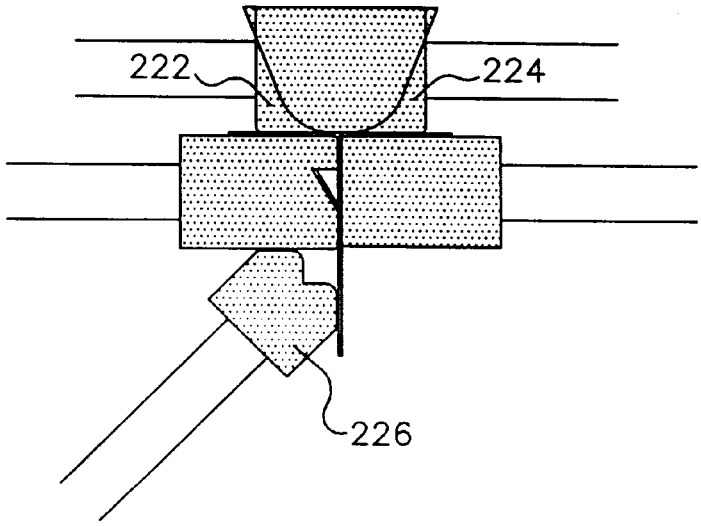
FIG. 32 illustrates a step in a method of making a wallboard clip.
Figure 33:
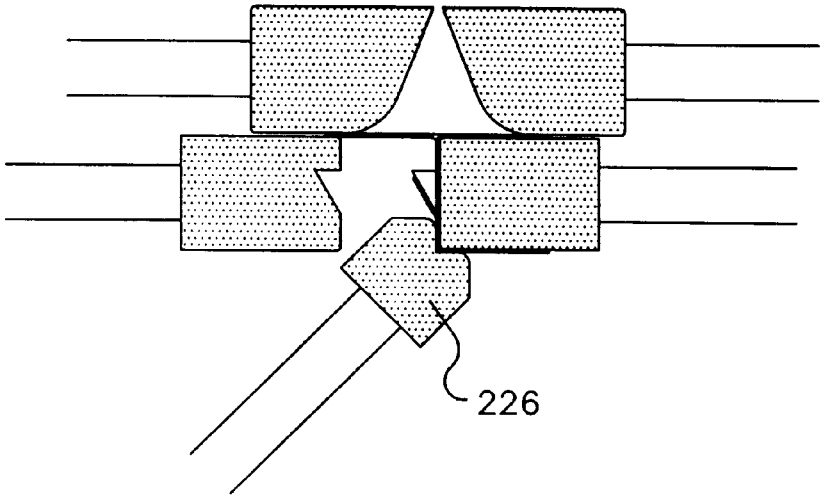
FIG. 33 illustrates a step in a method of making a wallboard clip.
Figure 34:
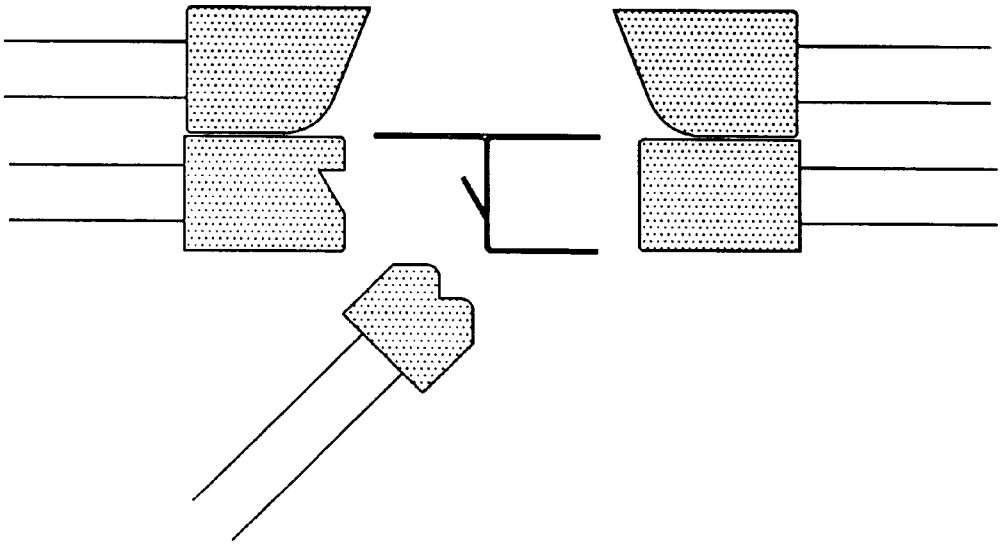
FIG. 34 illustrates a step in a method of making a wallboard clip.
Figure 35:
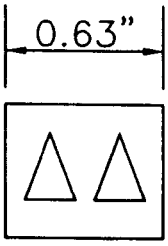
FIG. 35 illustrates suitable dies for use in a method of making a wallboard clip.
Figure 36:
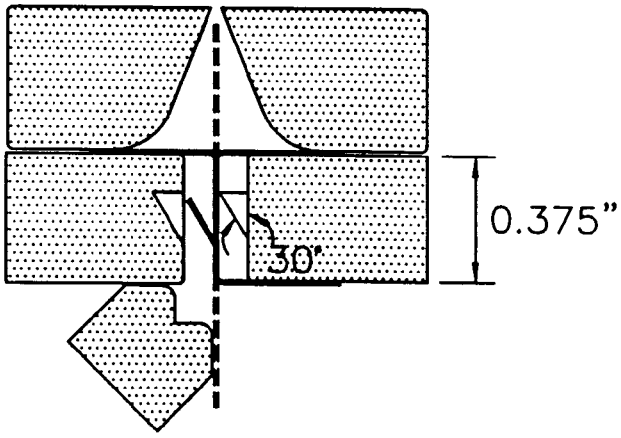
FIG. 36 illustrates suitable dies for use in a method of making a wallboard clip.
Figure 37:
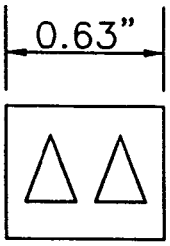
FIG. 37 illustrates suitable dies for use in a method of making a wallboard clip.
Figure 38:
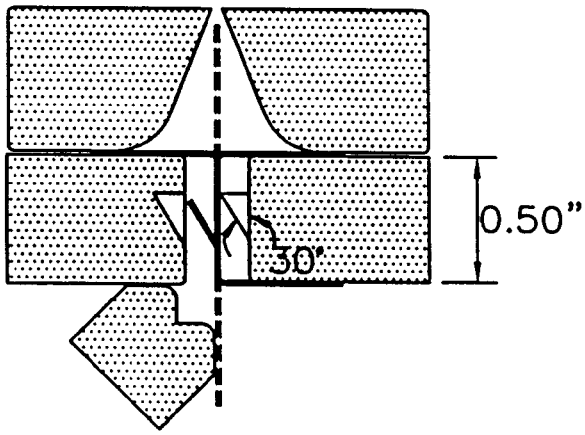
FIG. 38 illustrates suitable dies for use in a method of making a wallboard clip.

An example of a suitable method for making a wallboard clip 2 shown in FIG. 1 is illustrated in FIGS. 29 through 38, which includes the following steps:

a) providing a metal strip 200 having opposing first end 202 and second end 204, opposing first surface 206 and second surface 208, and an axis along the length of the metal strip, as shown in FIG. 29;

b) forming a securing structure 210 in the metal strip by clamping the strip between a die 212 having a depression 216 having shape of an outer surface of said securing structure 210 and a second die 214 having a protrusion 218 having a shape of an inner surface of said securing structure 210, as shown in FIGS. 30 and 31;

c) cutting the first end 202 of the metal strip substantially in a direction of the axis to form a first gripping member 6 and an existing wallboard gripping member 10 using the dies 222 and 224;

c) bending the first gripping member 6 in a first direction to form about a 90° angle or less in relation to the axis;

d) bending the existing wallboard gripping member 10 in a second direction substantially opposite to the first direction to form about a 90° angle or less in relation to the axis such that inner surfaces of the first and existing wallboard gripping members form about a 180° angle or less, as shown in FIG. 32, wherein a body member 5 being defined by a portion of the metal strip contacting the first and second gripping members; and e) bending the metal strip about 90° in relation to the axis in the first direction at an end of the body member 5 to provide a second gripping member 8 using the die 226, as shown in FIG. 33;

wherein the inner surfaces of the first and second gripping members are capable of capturing a peripheral portion of the inner and outer surfaces of the patch wallboard. FIG. 34 illustrates the formed wallboard clip being removed from the dies. FIGS. 35 and 36 illustrate suitable die sizes for forming a wallboard clip for use in securing a patch wallboard having a thickness of about ⅜ inch. FIGS. 37 and 38 illustrate suitable die sizes for forming a wallboard clip for use in securing a patch wallboard having a thickness of about ½ inch.

The steps (a) through (e) can be conducted in any order as desired. And formation of the wallboard clip is not limited to the method described above.

To provide a wallboard clip 2 as shown in FIG. 2, about a 1.5 inch strip of 30 gauge metal having a width of about ⅝ inch was used. To provide a wallboard clip 2 as shown in FIG. 4, about a 1.375 inch long strip of 30 gauge metal having a width of about ⅝ inch was used.

While the wallboard clip 2 can be formed from a continuous metal strip as shown in FIGS. 1–17, the wallboard clip 2 can also be formed from any suitable material as desired, such as plastics, metals, composites, wood materials, and mixtures thereof. The wallboard clip 2 can be molded, machined, extruded, formed by cutting, bending or pressing, or any other suitable method. For example, the wallboard clip 2 can be formed from extruded metals, such as aluminum. The wallboard clip 2 can also be formed from a plurality of separate parts which are coupled together, such as by bonding, welding, screwing, bolting, riveting, molding and adhesives. Based on the disclosure provided herein, one skilled the art will be able to select a suitable material for the desired wallboard clip. In order to comply with many building codes, the wallboard clip 2 should be formed from a non-flammable material. Preferably, the wallboard clip 2 is formed from a continuous strip of metal, and more preferably from a corrosion resistant flexible metal, such as stainless steel or corrosion treated steel including galvanized steel. The metal can be annealed to provide enhanced strength. The dimensions of the metal strip will depend on particular application and the type of metal utilized. For drywall having a thickness of about 1 inch or less, examples of suitable thicknesses of the metal are from about ⅛ inch or less, more preferably about 0.01 to about 0.02 inch thick, and examples of suitable widths are about 1 inch or less, preferably about ⅝ inch. However, if desired significantly wider wallboard clips can be formed for the desired application. For example, a wide wallboard clip can be used in place of thinner wallboard clips if desired.

As the size the patch wallboard and hole increases, the number of wallboard clips or size of the wallboard clips can be increased. Generally, the greater the size of the patch wallboard and hole, the greater the number of wallboard clips required. The number of wallboard clips required will depend on local building codes and the type of wallboard material utilized. Usually, when using drywall as the wallboard material, local building codes can be complied with using a sufficient number of wallboard clips such that the spacing between the wallboard clips is about 5 to 8 inches, preferably about 6 inches.

While the invention has been described in detail and with reference to specific embodiments thereof, it will be apparent to those of ordinary skill in the art that various changes and modifications can be made to the claimed invention without departing from the spirit and scope thereof. For example, any locking structure having an insertion position that allows the patch wallboard to be installed and a securing position which contacts an inner surface of the existing wallboard when the patch wallboard is in a repaired position can be utilized in the wallboard clip.

What is claimed is:

1. A wallboard clip for securing a patch wallboard to an existing wallboard to repair the existing wallboard, the wallboard clip comprising:

patch wallboard receiving structure constructed and arranged to receive a patch wallboard so as to capture a peripheral portion of inner and outer opposing surfaces of the patch wallboard;

an existing wallboard gripping member constructed and arranged to contact a peripheral portion of an outer surface of an existing wallboard to be repaired, said existing wallboard gripping member being coupled to said patch wallboard receiving structure such that the peripheral portion of the outer surface of the patch wallboard and the peripheral portion of the outer surface of the existing wallboard are arranged substantially in a common plane when the patch wallboard is in a repaired position within the existing wallboard; and securing structure coupled to the existing wallboard gripping member, said securing structure being constructed and arranged to an contact a side surface of the existing wallboard to secure the patchboard in the repaired position, wherein an outer surface of said wallboard clip exposed when said patchboard is secured in the repaired position being suitable for concealing by patching techniques.

2. A wallboard clip according to claim 1, wherein said outer exposed surface of said wallboard clip is suitable for concealing by taping, plastering, applying joint compound, or spackling over.

3. A wallboard clip according to claim 1, wherein said outer exposed surface is free of large ridges, bumps or other protrusions, which are capable of causing protrusions when covered by conventional taping and spackling techniques.

4. A wallboard clip according to claim 1, wherein said outer exposed surface is free of protrusions having a height of about ⅛ inch or greater.

5. A wallboard clip according to claim 1, wherein said outer exposed surface is free of protrusions having a height of about 0.05 inch or greater.

6. A wallboard clip according to claim 1, wherein said exposed outer surface includes small ridges, bumps or other protrusions which are capable of being concealed by patching techniques.

7. A wallboard clip according to claim 6, wherein said small protrusions have a height of about ⅛ inch or less.

8. A wallboard clip according to claim 6, wherein said small protrusions have a height of about 0.05 inch or less.

9. A wallboard clip according to claim 1, wherein said wallboard clip is formed from a continuous strip of metal.

10. A wallboard clip according to claim 1, wherein said wallboard clip is formed from a molded or extruded material.

11. A wallboard clip according to claim 1, wherein said wallboard clip is formed from an extruded polymeric material.

12. A wallboard clip according to claim 1, wherein said wallboard clip is formed from an extruded metal.

13. A wallboard clip according to claim 1, wherein said patch wallboard receiving structure comprises first and second gripping members having inner surfaces which are spaced apart about the thickness of the patch wallboard.

14. A wallboard clip according to claim 13, wherein exposed outer surfaces of said first gripping member and said existing wallboard gripping member are substantially on a common plane when the patch wallboard is in a repaired position within the existing wallboard to enhance concealing by patching techniques.

15. A wallboard clip according to claim 13, wherein thicknesses of said first gripping member and existing wallboard gripping member are sufficiently thin to be concealed by patching techniques.

16. A wallboard clip according to claim 15, wherein said first gripping member and existing wallboard gripping member have a thickness of about ⅛ inch or less.

17. A wallboard clip according to claim 15, wherein said first gripping member and existing wallboard gripping member have a thickness of about 0.05 inch or less.

18. A wallboard clip according to claim 15, wherein said first gripping member and existing wallboard gripping member have a thickness of about 0.02 inch or less.

19. A wallboard clip according to claim 1, wherein said patch wallboard receiving structure comprises first and second gripping members having inner surfaces which are substantially parallel to one another.

20. A wallboard clip according to claim 1, wherein said securing structure comprises at least one spur.

21. A wallboard clip according to claim 1, wherein said securing structure comprises at least one tooth, spike and barb.

22. A wallboard clip according to claim 1, wherein said securing structure comprises at least one ridge or bump.

23. A wallboard clip according to claim 1, wherein said securing structure is constructed and arranged to dig into a side surface of the existing wallboard.

24. A wallboard clip according to claim 1, wherein said securing structure is constructed and arranged to avoid digging into a side surface of the existing wallboard.

25. A wallboard clip according to claim 1, wherein said securing structure is constructed and arranged to provide less friction or grip against a side surface of the existing wallboard in an installation direction than an opposing direction.

26. A wallboard clip according to claim 1, wherein said securing structure is formed from a polymeric material.

27. A wallboard clip according to claim 1, wherein said securing structure is formed of the material used to form the wallboard clip.

28. A wallboard clip according to claim 1, wherein said securing structure comprises an adhesive.

29. A wallboard clip according to claim 1, further comprising a locking structure constructed and arranged to contact an inner surface of the existing wallboard when the patch wallboard is in a repaired position within the existing wallboard.

30. A wallboard clip according to claim 13, wherein a distance between inner surfaces of said first and second gripping members is less than a thickness of a patch wallboard and said first gripping member is formed from a flexible material such that during installation of the peripheral portion of the patch wallboard into said patch wallboard receiving structure said first gripping member flexes away from said second gripping member to allow the peripheral portion of the patch wallboard to slide into said patch wallboard receiving structure and to capture the patch wallboard by providing tension between said inner surfaces of said first and second gripping members and the inner and outer peripheral portions of the patch wallboard.

31. A wallboard clip according to claim 1, wherein said patch wallboard receiving structure comprises first and second gripping members, said first gripping member being sloped towards said second gripping member such that during installation of the wallboard clip onto the patch wallboard said first gripping member flexes away from said second gripping member providing tension between the inside surfaces of said first and second gripping members and opposing peripheral portions of the patch wallboard there between.

32. A wallboard clip according to claim 31, wherein an outer surface of said first gripping member and an outer surface of said existing wallboard member form a substantially common plane when the patch wallboard is in a repaired position.

33. A wallboard clip according to claim 1, wherein said wallboard clip is formed from a metal strip having a thickness of about ⅛ inch or less.

34. A wallboard clip according to claim 1, wherein said wallboard clip is formed from a metal strip having a thickness of from about 0.01 to about 0.02 inches.

35. A wallboard clip according to claim 1, wherein said wallboard clip is formed from a corrosion resistant metal.

36. A wallboard clip according to claim 35, wherein said wallboard clip is formed from a galvanized metal.

37. A wallboard clip according to claim 35, wherein said wallboard clip is formed from stainless steel.

38. A wallboard clip according to claim 1, wherein said patch wallboard receiving structure is constructed to capture drywall having a thickness of from about ⅜ to 1.5 inches.

39. A wallboard clip according to claim 38, wherein said patch wallboard receiving structure is constructed to capture drywall having a thickness of about ⅜ inch.

40. A wallboard clip according to claim 38, wherein said patch wallboard receiving structure is constructed to capture drywall having a thickness of about ½ inch.

41. A wallboard clip according to claim 38, wherein said patch wallboard receiving structure is constructed to capture drywall having a thickness of about ⅝ inch.

42. A wallboard clip according to claim 1, wherein said patch wallboard receiving structure comprises first and second gripping members coupled to a body member, and said securing structure being formed on said body member, such that said securing structure is coupled to said existing wallboard receiving member via said body member.

43. A wallboard clip according to claim 1, wherein said patch wallboard receiving structure comprises first and second gripping members coupled to a body member, and said securing structure bound to an end of said body member.

44. A wallboard clip according to claim 13, wherein inner surfaces of said first and existing wallboard gripping members forming an angle of about 180° or less.

45. A wallboard clip according to claim 44, wherein said inner surfaces of said first and existing wallboard gripping members forming an angle of about 160° to about 179°.

46. A wallboard clip according to claim 44, wherein said inner surfaces of said first and existing wallboard gripping members forming an angle of about 170° to about 178°.

47. A method of making a wallboard clip for securing a patch wallboard to an existing wallboard to repair the existing wallboard, said method comprising;

a) providing a metal strip having opposing first and second ends, opposing first and second surfaces, and an axis along the length of the metal strip;

b) forming a securing structure constructed and arranged such that said securing structure grips a side of the existing wallboard and secures the existing wallboard when the patch wallboard is in a repaired position within the existing wallboard, c) cutting the first end of the metal strip substantially in a direction of the axis to form first and existing wallboard gripping members;

d) bending the first gripping member in a first direction to form about a 90° angle or less in relation to the axis;

e) bending the existing wallboard gripping member in a second direction substantially opposite to the first direction to form about a 90° angle or less in relation to the axis such that inner surfaces of the first and existing wallboard gripping members form about a 180° angle or less; and f) bending a portion of the second end of the metal strip about 90° in relation to the axis in the first direction to provide a second gripping member, wherein a body member being defined by a portion of the metal strip defined between the first and second gripping members;

wherein a distance between an inner surface of the first gripping member and an inner surface of the second gripping member is about the thickness of a patch wallboard such that the inner surfaces of the first and second gripping members are capable of capturing a peripheral portion of the inner and outer surfaces of the patch wallboard, and wherein an inner surface of the existing wallboard gripping member and the inner surface of the first gripping member are constructed and arranged such that when the patch wallboard is in a repaired position peripheral portions of the outer surfaces of the existing wallboard and the patch wallboard are on substantially a common plane.

48. A method according to claim 47, wherein said steps c through e are conducted prior to said step b.

49. A method according to claim 47, wherein said steps d and e are conducted such that said inner surfaces of said first and existing wallboard gripping members form an angle of about 160° to about 179° to provide tension against peripheral portions of the patch wallboard and existing wallboard.

50. A method according to claim 47, wherein said steps d and e are conducted such that said inner surfaces of said first and existing wallboard gripping members form an angle of about 170° to about 178° to provide tension against peripheral portions of the patch wallboard and existing wallboard.

51. A method according to claim 47, wherein said wallboard clip is formed from a corrosion resistant metal.

52. A method according to claim 51, wherein said corrosion resistant metal comprises galvanized steel.

53. A method according to claim 51, wherein said corrosion resistant metal comprises stainless steel.

54. A method according to claim 47, wherein said method conducted such that an outer exposed surface of said wallboard clip is suitable for concealing by taping, plastering, applying joint compound, or spackling over.

55. A method according to claim 54, wherein said outer exposed surface is free of large ridges, bumps or other protrusions, which are capable of causing protrusions when covered by conventional taping and spackling techniques.

56. A method according to claim 55, wherein said outer exposed surface is free of protrusions having a height of about ⅛ inch or greater.

57. A method according to claim 55, wherein said outer exposed surface is free of protrusions having a height of about 0.05 inch or greater.

58. A method according to claim 54, wherein said exposed outer surface includes small ridges, bumps or other protrusions which are capable of being concealed by patching techniques.

59. A method according to claim 58, wherein said small protrusions have a height of about ⅛ inch or less.

60. A method according to claim 58, wherein said small protrusions have a height of about 0.05 inch or less.

61. A method according to claim 47, wherein said method is conducted such that exposed outer surfaces of said first gripping member and said existing wallboard gripping member are substantially on a common plane when the patch wallboard is in a repaired position within the existing wallboard to enhance concealing by patching techniques.

62. A method according to claim 47, wherein thicknesses of said metal strip is sufficiently thin to be concealed by patching techniques.

63. A method according to claim 47, wherein said metal strip has a thickness of about ⅛ inch or less.

64. A method according to claim 47, wherein said metal strip has a thickness of about 0.05 inch or less.

65. A metal strip according to claim 47, wherein said metal strip has a thickness of about 0.02 inch or less.

66. A method according to claim 47, wherein said securing structure comprises at least one spur.

67. A method according to claim 47, wherein said securing structure comprises at least one tooth, spike and barb.

68. A method according to claim 47, wherein said securing structure comprises at least one ridge or bump.

69. A method according to claim 47, wherein said securing structure is constructed and arranged to dig into a side surface of the existing wallboard.

70. A method according to claim 47, wherein said securing structure is constructed and arranged to avoid digging into a side surface of the existing wallboard.

71. A method according to claim 47, wherein said securing structure is constructed and arranged to provide less friction or grip against a side surface of the existing wallboard in an installation direction than an opposing direction.

72. A method according to claim 47, wherein further comprising the step of adding an adhesive to said securing structure.

73. A method according to claim 47, further comprising the step of forming a locking structure constructed and arranged to contact an inner surface of the existing wallboard when the patch wallboard is in a repaired position within the existing wallboard.

74. A method according to claim 47, wherein a distance between inner surfaces of said first and second gripping members is less than a thickness of a patch wallboard and said first gripping member is formed from a flexible material such that during installation of the peripheral portion the patch wallboard into said patch wallboard receiving structure said first gripping member flexes away from said second gripping member to allow the peripheral portion of the patch wallboard to slide into said patch wallboard receiving structure and to capture the patch wallboard by providing tension between said inner surfaces of said first and second gripping members and the inner and outer peripheral portions of the patch wallboard.

75. A method according to claim 47, wherein said first gripping member being sloped towards said second gripping member such that during installation of the wallboard clip onto the patch wallboard said first gripping member flexes away from said second gripping member providing tension between the inside surfaces of said first and second gripping members and opposing peripheral portions of the patch wallboard there between.

76. A method according to claim 47, wherein an outer surface of said first gripping member and an outer surface of said existing wallboard member form a substantially common plane when the patch wallboard is in a repaired position.

77. A method according to claim 47, wherein said first and second gripping members are constructed to capture drywall having a thickness of from about ⅜ to 1.5 inches.

78. A method according to claim 47, wherein said first and second gripping members are constructed to capture drywall having a thickness of about ⅜ inch.

79. A method according to claim 47, wherein said patch first and second gripping members are constructed to capture drywall having a thickness of about ½ inch.

80. A method according to claim 47, wherein said first and second gripping members are constructed to capture drywall having a thickness of about ⅝ inch.

81. A method of repairing a hole in an existing wallboard using a wallboard clip comprising:

patch wallboard receiving structure constructed and arranged to receive a patch wallboard so as to capture a peripheral portion of inner and outer opposing surfaces of the patch wallboard;

an existing wallboard receiving member constructed and arranged to contact of peripheral portion of an outer surface of an existing wallboard to be repaired, said existing wallboard receiving member being coupled to said patch wallboard receiving structure such that the peripheral portion of said outer surface of the patch wallboard and the peripheral portion of the outer surface of the existing wallboard are arranged substantially in a common plane when the patch wallboard is in a repaired position within the existing wallboard; and securing structure; said method comprising:

a) providing a patch wallboard having a surface area larger than a hole to be repaired in the existing wallboard;

b) tracing an outline of the patch wallboard on the existing wallboard which surrounds the hole to be repaired;

c) cutting out the trace on the existing wallboard;

d) inserting at least two of said wallboard clips onto the patch wallboard such that peripheral portions of the inner an outer surfaces of the patch wallboard are captured by said patch wallboard receiving structure; and e) inserting the patch wallboard containing the wallboard clips into the hole until the patch wallboard reaches a repaired position in which the outer and side surfaces of the existing wallboard are captured by said securing structure and said existing wallboard receiving structure.

82. A method according to claim 81 further comprising the step of patching the line between the patch wallboard and the existing wallboard.

83. A method according to claim 82, wherein said patch step comprises at least one of taping, plastering, applying joint compound, or spackling.

84. A method of repairing a hole in an existing wallboard using a wallboard clip comprising:

a) providing a patch wallboard sized to fit within a hole to be repaired in the existing wallboard;

d) inserting at least two wallboard clips onto the patch wallboard such that peripheral portions of the inner an outer surfaces of the patch wallboard are captured by the wallboard clip; and e) inserting the patch wallboard containing the wallboard clips into the hole until the patch wallboard reaches a repaired position in which outer and side surfaces of the existing wallboard are captured by the wallboard clip.

85. A method according to claim 84, wherein step (a) further comprises the steps of providing a patch wallboard having a surface area larger than an initial hole to be repaired in the existing wallboard; tracing an outline of the patch wallboard on the existing wallboard which surrounds the initial hole to be repaired; cutting out the trace on the existing wallboard to form a hole to be repaired in which the patch wallboard is sized to fit within.

86. A method according to claim 84, wherein said wallboard comprises drywall.

87. A method of accessing an interior of a hollow wall using wallboard clips, the method comprising:

cutting a hole in an existing wallboard, wherein a patch wallboard is defined by the cut;

removing the patch wallboard from the existing wallboard;

applying a plurality of wallboard clips to peripheral portions of the patch wallboard; and inserting the patch wallboard containing wallboard clips into the hole such that said wallboard clips secure the patch wallboard within the existing wallboard, wherein said wallboard clip attaches to the patch wallboard such that peripheral portions of the inner and outer surfaces of the patch wallboard are captured by the wallboard clip; and inserting the patch wallboard containing the wallboard clips into the hole until the patch wallboard reaches a repaired position in which outer and side surfaces of the existing wallboard are captured by the wallboard clips.

88. A method according to claim 87, wherein said wallboard comprises drywall.

89. A method according to claim 87, wherein said wallboard clips are formed from a metal.

90. A method according to claim 87, wherein said wallboard clip comprises a patch wallboard receiving structure constructed and arranged to receive a patch wallboard so as to capture a peripheral portion of inner and outer opposing surfaces of a patch wallboard;

an existing wallboard receiving member constructed and arranged to contact of peripheral portion of an outer surface of an existing wallboard to be repaired, said existing wallboard receiving member being coupled to said patch wallboard receiving structure such that the peripheral portion of the outer surface of the patch wallboard and the peripheral portion of the outer surface of the existing wallboard are arranged substantially in a common plane when the patch wallboard is in a repaired position within the existing wallboard; and securing structure.

91. A patch wallboard for repairing a hole in existing wallboard comprising:

a patch wallboard; and a plurality of wallboard clips mounted around a periphery of said patch wallboard and capturing peripheral portions of the inner and outer surfaces of the patch wallboard, said wallboard clips being constructed and arranged to capture outer and side surfaces of an existing wallboard when said patch wallboard is in an installation position within the existing wallboard.

92. A patch wallboard for repairing a hole in existing wallboard comprising:

a patch wallboard; and a plurality of wallboard clips mounted around a periphery of said patch wallboard, said wallboard clips being constructed and arranged to capture outer and side surfaces of an existing wallboard when said patch wallboard is in an installation position within the existing wallboard, wherein said wallboard clips are integrally formed with said patch wallboard.

93. A patch wallboard according to claim 91, wherein said wallboard clips comprise an existing wallboard receiving member and a securing structure.

94. A patch wallboard according to claim 91, wherein said wallboard clip comprises at least one spur.

95. A patch wallboard according to claim 91, wherein said wallboard clip comprises at least one tooth, spike and barb.

96. A patch wallboard according to claim 91, wherein said wallboard clip comprises at least one ridge or bump.

97. A patch wallboard according to claim 91, wherein said wallboard clip is constructed and arranged to dig into a side surface of the existing wallboard.

98. A patch wallboard according to claim 91, wherein said wallboard clip is constructed and arranged to avoid digging into a side surface of the existing wallboard.

99. A patch wallboard according to claim 91, wherein said wallboard clip is constructed and arranged to provide less friction or grip against a side surface of the existing wallboard in an installation direction than an opposing direction.

100. A patch wallboard according to claim 91, wherein said wallboard clip is formed from a polymeric material.

101. A patch wallboard according to claim 91, wherein said wallboard clip comprises an adhesive.

102. A patch wallboard according to claim 91, further comprising a locking structure constructed and arranged to contact an inner surface of the existing wallboard when the patch wallboard is in a repaired position within the existing wallboard.

* * * * *

UNITED STATES PATENT AND TRADEMARK OFFICE

CERTIFICATE OF CORRECTION

PATENT NO. : 6,209,277 B1
DATED : April 3, 2001
INVENTOR(S) : DiGate

It is certified that error appears in the above-identified patent and that said Letters Patent is hereby corrected as shown below:

Column 12,
Line 30, delete "an".

Signed and Sealed this

Tenth Day of June, 2003

JAMES E. ROGAN
*Director of the United States Patent and Trademark Office*